US006031345A

United States Patent [19]

Nakata

[11] Patent Number: 6,031,345

[45] **Date of Patent: *Feb. 29, 2000**

[54] COLOR CRT HAVING A SELF-CONVERGING DEFLECTION YOKE

[75] Inventor: Shuhei Nakata, Tokyo, Japan

[73] Assignee: Mitsubishi Denki Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/655,646

[22] Filed: May 30, 1996

[30] Foreign Application Priority Data

Jun. 1, 1995 [JP] Japan ..... 7-135269
Feb. 19, 1996 [JP] Japan ..... 8-030843

[51] Int. Cl.[7] ..... G09G 1/28

[52] U.S. Cl. ..... 315/368.28; 313/440

[58] Field of Search ..... 315/368.26, 368.27, 315/368.28, 368.15; 313/440, 442

[56] References Cited

U.S. PATENT DOCUMENTS

| | | | |
|---|---|---|---|
| Re. 35,548 | 7/1997 | Sluyterman et al. | 315/368.28 |
| 4,900,979 | 2/1990 | Shimoma et al. . | |
| 4,988,926 | 1/1991 | Sluyterman et al. . | |
| 5,027,042 | 6/1991 | Sluyterman et al. . | |
| 5,196,768 | 3/1993 | Sluyterman | 315/368.28 |
| 5,327,051 | 7/1994 | Johnson et al. . | |
| 5,350,967 | 9/1994 | Chen | 313/412 |
| 5,367,230 | 11/1994 | Iguchi et al. | 315/368.15 |
| 5,418,421 | 5/1995 | Hasegawa et al. . | |
| 5,517,078 | 5/1996 | Sugawara et al. | 313/412 |
| 5,565,732 | 10/1996 | Sluyterman et al. . | |
| 5,663,609 | 9/1997 | Kamohara et al. | 313/412 |

FOREIGN PATENT DOCUMENTS

| | | |
|---|---|---|
| 0382299 A1 | 8/1990 | European Pat. Off. . |
| 0507382 A1 | 10/1992 | European Pat. Off. . |
| 0507383 A1 | 10/1992 | European Pat. Off. . |
| 5508514 | 11/1993 | Japan . |

OTHER PUBLICATIONS

A–159992 Enhanced Elliptical Aperture Lens Gun for Color Picture Tubes, S. Shirai et al, pp. 185–191.

*Primary Examiner*—Gregory C. Issing

[57] ABSTRACT

In a color CRT having an in-line electron gun and a self-converging deflection yoke, a first quadrupole electro-magnetic coil is provided on the deflection yoke, and is wider at the screen side than at the neck side, and a second quadrupole electro-magnetic coil which is provided on the deflection yoke and which is wider at the neck side than at the screen side. The main lens of the in-line electron gun may have a cross section of a race-track shape. A deflection electrode provided for deflecting the side beams may be provided in the vicinity of the main lens of the in-line electron gun. A quadrupole electric-field lens may be additionally provided for correcting an astigma of the side beam, provided in the vicinity of the deflection electrode.

21 Claims, 30 Drawing Sheets

COLOR CRT HAVING A SELF-CONVERGING DEFLECTION YOKE

BACKGROUND OF THE INVENTION

The present invention relates to a color CRT, and in particular improvement in the picture quality, specifically the resolution, of a color CRT.

Conventional color CRTs adopt various measures to improve the picture quality. However, new problems are encountered with increasing requirements regarding picture quality, particularly, resolution. Such problems are discussed below.

FIG. 25 shows a cross section of electrodes in a conventional electron gun shown for instance in an article, S. Shirai, et al. "Enhanced Elliptical Aperture Lens Gun for Color Picture Tubes," Proceedings of SID, Vol. 31/3, 1990. In the figure, reference numeral 31 denotes an electrode to which an anode voltage is applied. Reference numeral 32 denotes a DBF (dynamic beam forming) electrode to which a voltage which varies depending on the position on the screen at which the electron beam is impinging. Reference numeral 33 denotes a focus electrode to which a constant voltage is applied. Reference numerals 34, 35, 36, and 37 denote a triode section and a pre-lens system for generating an electron beam. Reference numeral 37 denotes a G1 electrode, and 36 denotes a G2 electrode.

FIG. 26A and FIG. 26B show the details of two different examples the DBF electrode. In these figures, reference numeral 100 denotes an electron beam.

The operation will next be described.

The function of a deflection yoke, which is not illustrated but which is one of the constituting elements, will first be described, before describing the function of the electron gun.

The deflection yoke in the color CRT has the function of deflecting the three electron beams 100 to the respective point on the screen, but also the function of converging the three electron beams to a single point (self convergence function). This is necessary to improve the color purity.

First, let us consider a situation where the beams 100 are directed to the center of the screen. In this case, no magnetic field is generated by the deflection yoke. The lens of the electron gun is designed so that the electron beams 100 are emitted at an angle with respect to each other so that the three beams converge at a point on the screen.

The situation when the electron beams which are emitted at an angle with respect to each other are deflected by the deflection yoke will next be described.

When the beams are deflected by the deflection yoke, the length of the trajectory of the beam to the screen will be longer than when the beam is directed to the center. If the beams are simply deflected, the center beam (G beam) and side beams (R and B beams) cross each other before the screen, so that they are not converged on the screen. This means that the desired color is not reproduced at the desired position.

To solve this problem, the deflection yoke generates a magnetic field for horizontal deflection which is increased with the distance from the center axis. The magnetic field having such a distribution is called a pincushion magnetic field. The magnetic field having the opposite distribution is called a barrel magnetic field.

When the magnetic field is generated, the beam on the outer side is subject to a greater deflection, while the beam on the inner side is subject to a smaller deflection. As a result, the beams tend not to cross before the screen.

By optimizing the functions of the magnetic field, the three beams can be made to converge on the screen.

If this function is seen as an action of a lens, it can be considered as a diverging lens, because there is a function of increasing the distance of the side beams in the horizontal direction. In the vertical direction, the magnetic field forms a converging lens by nature.

However, selecting the pincushion magnetic field alone is not enough to converge the three beams. This is because the freedom in adjustment is limited by restrictions. For instance, even if the R and B beams may be made to converge, the G beam may be offset from the point where the R and B beams are converged. For this reason, generally, a barrel magnetic field which is opposite to the pincushion magnetic field is generated at the neck part of the deflection yoke. The barrel magnetic field is a type of a 6-pole magnetic field, so that it acts on the G beam but imparts operations in an opposite direction to the R and B beams. By adjusting this magnetic field, in combination with the pincushion magnetic field, the three beams can be converged on the screen.

With regard to the horizontal direction, the three beams are converged throughout the screen because the lens for converging the beams is positioned between the electron gun and the screen. Accordingly, the focusing in the horizontal direction is satisfactory.

However, with regard to the vertical direction, because the converging lens is between the electron gun and the screen, the beams are in the state of overfocusing on the screen. For this reason, the picture on the screen is blurred.

In the conventional electron gun, the DBF electrode 32 shown in FIG. 25 forms a vertically diverging lens, so that it cancels the converging effect by the deflection yoke, to obtain a satisfactory focusing characteristic in the vertical direction on the screen.

To summarize the lens functions, a horizontally diverging lens is formed of the deflection yoke, while a vertically converging lens is formed of the deflection yoke. To prevent over-convergence in the vertical direction, the electron gun is provided with the DBF electrode 32 to which a voltage dependent on the position of the screen at which the beam is impinging is applied, so that the over-convergence in the vertical direction is alleviated.

According to the above prior art, a quadrupole (4-pole) electrode is generated in the electron gun to cope with the variation in the focusing characteristic generated by the deflection yoke. For this reason, a power supply for the generation of the quadrupole electric field is required, and the cost of the system is increased.

When seen as lenses, a horizontally diverging lens and a vertically converging lens are present near the screen, so that the magnification factor on the screen is different between horizontal and vertical directions.

Next, another prior art device will be described. FIG. 27A, FIG. 27B, FIG. 28A and FIG. 28B show a deflection system in a CRT disclosed in Japanese Patent Application Kohyou Publication No. 508,514/1993. FIG. 27A shows the general configuration of the system. FIG. 27B shows the astigma correction element 24 formed of a quadrupole electromagnet and a 45 degree-shifted quadrupole electromagnet. FIG. 28A shows a magnetic field generated by the quadrupole electromagnet, and FIG. 28B shows a waveform of a drive current for the quadrupole electromagnet.

This prior art device reduces the 6-pole magnetic field of the self-convergence yoke, to reduce the astigma generated by the 6-pole magnetic field, and supplies the two sets of quadrupole electromagnets with a dynamic drive current which varies depending on the beam spot, so that the three beams are converged.

The quadrupole magnetic field of the element 24 has the diverging function with respect to focusing, while the basic converging function is provided by the main lens of the electron gun. For this reason, the main plane of the converging lens system is made to approach the electron gun, and the magnification factor of the image is enlarged. As a result the spot diameter is increased. Moreover, it is necessary to supply the two sets of the quadrupole electromagnets with a dynamic drive current. The cost of the waveform generator and the power supply will then be considerable.

SUMMARY OF THE INVENTION

An object of the invention is to solve the problems described above, and to provide a CRT system which can realize a high resolution by improving the shape of the beam spot throughout the screen, and which is inexpensive.

According to one aspect of the invention, there is provided a color CRT having an in-line electron gun and a self-converging deflection yoke, comprising:

a first quadrupole electromagnetic coil which is provided on the deflection yoke, and which is wider at the screen side than at the neck side; and a second quadrupole electromagnetic coil which is provided on the deflection yoke and which is wider at the neck side than at the screen side.

With the above arrangement, the two sets of the quadrupole electromagnet coils provided at the deflection yoke forms a doublet arrangement. By virtue of the converging function of the doublet arrangement, the main plane position of the main lens is advanced toward the screen, so that the image magnification factor of the electron gun can be reduced, and the spot size of the electron beam can be reduced. As a result, a high resolution can be obtained. Moreover, the two sets of the quadrupole electromagnet coils are driven by a d.c. current, so that the drive circuit is inexpensive.

The main lens of the in-line electron gun may have a cross section of a race-track shape.

With the above arrangement, the two sets of the quadrupole electromagnet coils provided at the deflection yoke and the quadrupole lens function of the main lens form a triplet arrangement which is a combination of three quadrupole lenses. By virtue of the converging function of the triplet arrangement, the main plane position of the main lens is advanced toward the screen, so that the image magnification factor of the electron gun can be reduced, and the spot size of the electron beam can be reduced. Moreover, by virtue of the triplet arrangement of the quadrupole lenses, the astigma can be completely corrected. As a result, a high resolution can be obtained. Moreover, the two sets of the quadrupole electromagnet coils are driven by a d.c. current, so that the drive circuit is inexpensive.

A deflection electrode for deflecting the side beams may be provided in the vicinity of the main lens of the inline electron gun.

With the above arrangement, by virtue of the deflection electrode for deflecting the side beams, the cathode object point positions of the three beams can be effectively made to coincide. As a result, the effect is equivalent to a situation where the electron beams all originate from the same cathode. Thus the focusing conditions and the convergence condition in the subsequent lens system can be satisfied.

The CRT may be additionally provided with a sub yoke of a quadrupole permanent magnet or a quadrupole electromagnet driven by a d.c. current, provided at the neck part of the deflection yoke.

With the above arrangement, the two sets of the quadrupole electromagnets in the deflection yoke and the sub yoke of the quadrupole electromagnet forms a triplet arrangement comprising three quadrupole lenses. Accordingly, the effects similar to that described above can be obtained.

The horizontal deflection magnetic field of the deflection yoke may be altered along the axis of the CRT so that it is barrel-shaped, then pincushion-shaped, and then barrel-shaped toward the screen. The in-line electron gun is configured as to have the different converging power between vertical and horizontal directions.

With the above arrangement, by virtue of the barrel-pincushion-barrel distribution of the horizontal deflection magnetic field formed of the two sets of the quadrupole electromagnet coils in the deflection yoke, and the deflection yoke, and the astigma of the electron gun, a triplet arrangement is formed at the center of the screen. As a result, the effects similar to that described above can be obtained. When the beam is deflected to the peripheral portion of the screen, focusing in both the horizontal and vertical, directions can be attained. The triplet arrangement can be formed, so that the dynamic voltages which were required in the past can be eliminated.

According to another aspect of the invention, there is provided a color CRT having an in-line electron gun and a self converging yoke, comprising a main lens provided in the electron gun and having a cross section in the form of a race-track. A deflection electrode is provided in the vicinity of the main lens for deflecting the side beams. A quadrupole electric field lens is provided in the vicinity of the deflection yoke, and a quadrupole electromagnet coil is provided on the deflection yoke and driven by a d.c. current.

With the above arrangement, by virtue of the quadrupole lens function having a main lens of the race-track shape, the quadrupole electric field lens provided in the vicinity of the deflection electrode for the side beams, and the quadrupole electromagnet coils provided at the deflection yoke forms a triplet configuration comprising three quadrupole lenses. By virtue of the converging function of the triplet arrangement, the main plane of the main lens can be advanced toward the screen, and the image magnification factor can be reduced, and the spot size can be reduced. Moreover, because of the function of the triplet arrangement, the astigma can be completely corrected.

Accordingly, the resolution can be improved. Furthermore, because of the deflection yoke, the equivalent cathode positions of the center and side beams can be made to coincide. Thus the focusing conditions and the convergence conditions can be satisfied.

According a further aspect of the invention, there is provided a color CRT having an in-line electron gun and a self converging yoke, comprising a main lens provided in the electron gun and having a cross section in the form of a race-track. A deflection electrode is provided in the vicinity of the main lens for deflecting the side beams. A quadrupole electro-magnet coil is provided on the deflection yoke and driven by a d.c. current, and a sub yoke of a quadrupole electro-magnet is provided at the neck part of the deflection yoke and driven by a d.c. current.

With the above arrangement, by virtue of the quadrupole lens function of the main lens having a race-track shape, the quadrupole electromagnet coil provided at the deflection yoke, and the sub yoke of the quadrupole electromagnet provided at the deflection yoke neck part, a triplet arrangement containing three quadrupole lenses is formed. By the action of the side beam deflection electrode, the cathode positions of the side and center beams can be made to coincide. The effects similar to those described above can therefore be obtained.

BRIEF DESCRIPTION OF THE DRAWINGS

In the accompanying drawings.

DETAILED DESCRIPTION OF THE PREFERRED EMBODIMENTS

Embodiment 1

Figure 1:
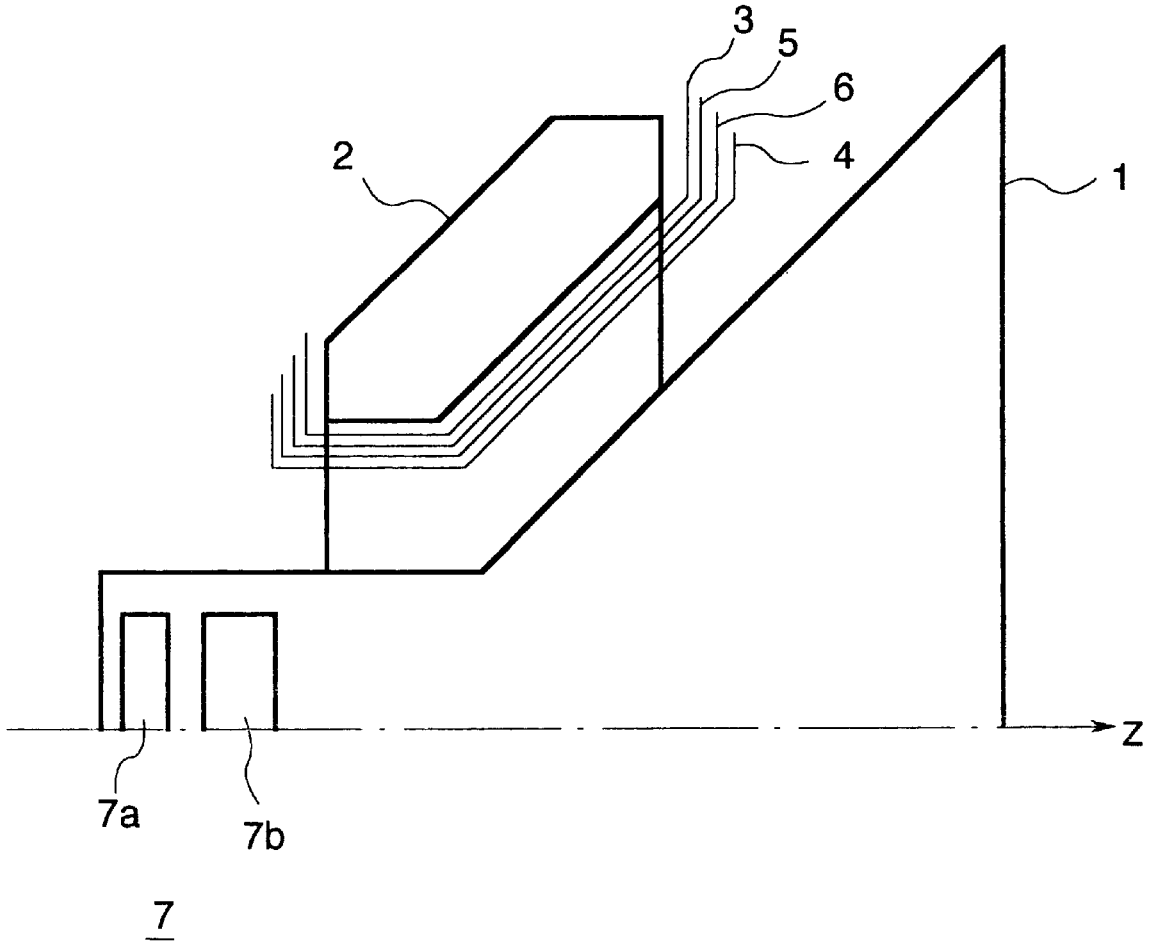
FIG. 1 is a schematic diagram showing the configuration of quadrupole electromagnetic coils according to a first embodiment (Embodiment 1) of the present invention.

FIG. 1 shows the configuration of a first embodiment (Embodiment 1) of the present invention. Reference numeral 1 denotes a CRT tube, 2 denotes a magnetic core of a deflection yoke, 3 denotes a vertical deflection yoke, 4 denotes a horizontal deflection yoke, and 5 and 6 denote two quadrupole electromagnet coils producing magnetic fields of different polarities. 7*a* denotes an RGB in-line type triode section of the electron gun, and 7*b* denotes a main lens.

Figure 2A:
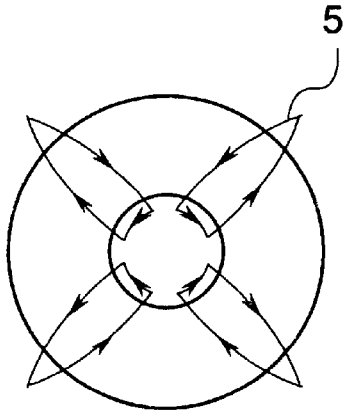
FIG. 2A and FIG. 2B show the shapes of the windings of quadrupole electromagnet coils in Embodiment 1.
Figure 2B:
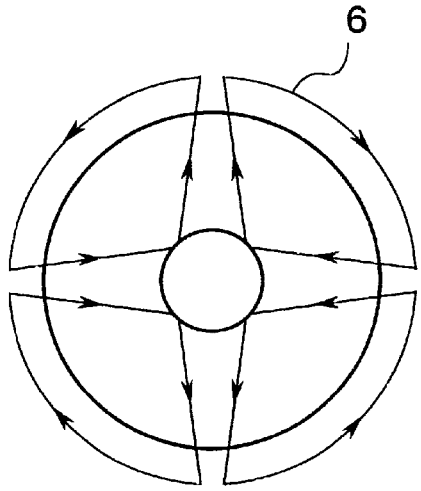
Figure 3A:
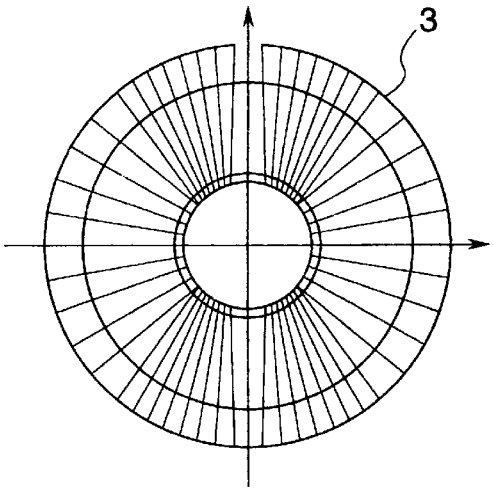
FIG. 3A and FIG. 3B show a general shape of the windings of vertical and horizontal deflection coils.
Figure 3B:
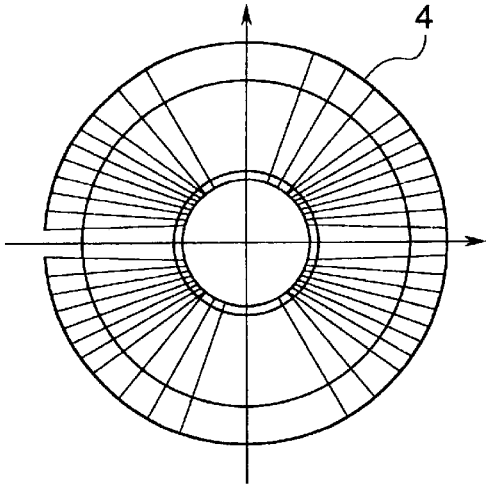

FIG. 2A and FIG. 2B show the shapes of the windings of the quadrupole electromagnet coils 5 and 6. The coil is wider at the neck part of the deflection yoke, and is narrower at the screen side. The coil 6 is of the opposite shape. FIG. 3A and FIG. 3B show a general shape of the coil windings of the vertical deflection yoke 3 and horizontal deflection yoke 4.

Figure 2C:
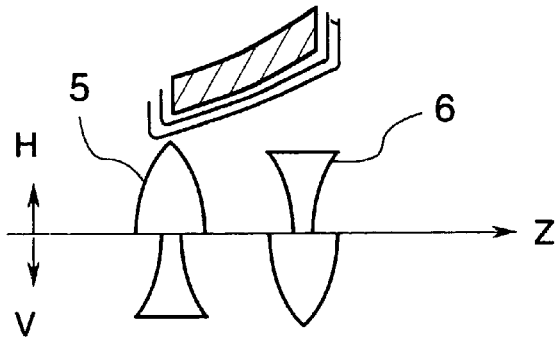
FIG. 2C shows the function of the quadrupole magnetic field.

When the electron beam passes the deflection yoke, it is first strongly affected by the magnetic field of the wider coil 5 at the neck part. When the electron beam passes near the screen, it is strongly affected by the coil 6. If the strength of the magnetic field of the coil 5 and the strength of the magnetic field of the coil 6 are made to be different from each other, the quadrupole magnetic field affecting the electron beam which travels through the deflection yoke can be varied. If the currents passing through the coils 5 and 6 are of opposite polarities, the polarity of the quadrupole magnetic field in the neck part and the polarity of the quadrupole magnetic field on the screen side can be made opposite to each other. If the directions of the currents in the coils 5 and 6 are opposite from each other as shown in FIG. 2A and FIG. 2B, then the function of the quadrupole magnetic field is as is schematically shown in FIG. 2C.

The convex and concave lens marks shown in the above and below the horizontal line Z indicate the converging and diverging functions of the quadrupole magnetic field on the electron beam. The part above the horizontal axis shows the function in the horizontal direction (of the screen), while the part below the horizontal axis shows the function in the vertical direction (of the screen). In the drawing, the converging function is indicated by the convex lens mark, while the diverging function is indicated by the concave lens mark. At the neck part of the deflection yoke, the coil 5 is wider than the coil 6, so that the coil 5 gives a stronger effect, and the horizontally converging effect and vertically diverging diverging effect are given. On the screen side of the deflection yoke, the coil 6 gives a stronger effect, and the horizontally diverging and vertical converging effects are given. Such a lens arrangement is called a doublet arrangement in the field of optics, and it is possible to have such an arrangement to have a converging effect, when taken as a whole.

Figure 4A:
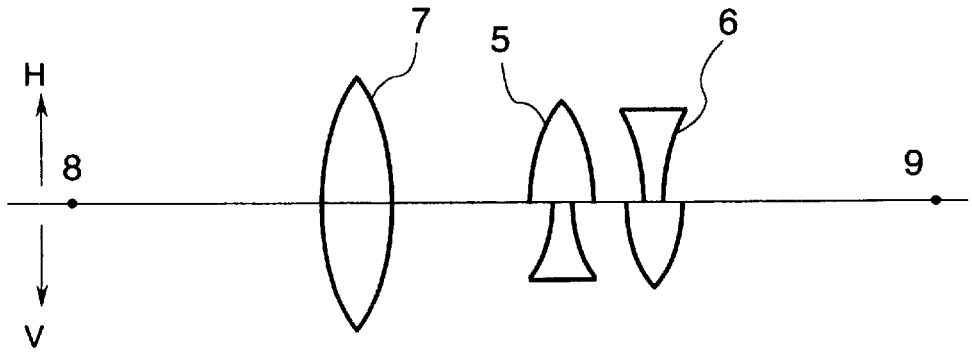
FIG. 4A and FIG. 4B schematically illustrate the function of the quadrupole electromagnets.
Figure 4B:
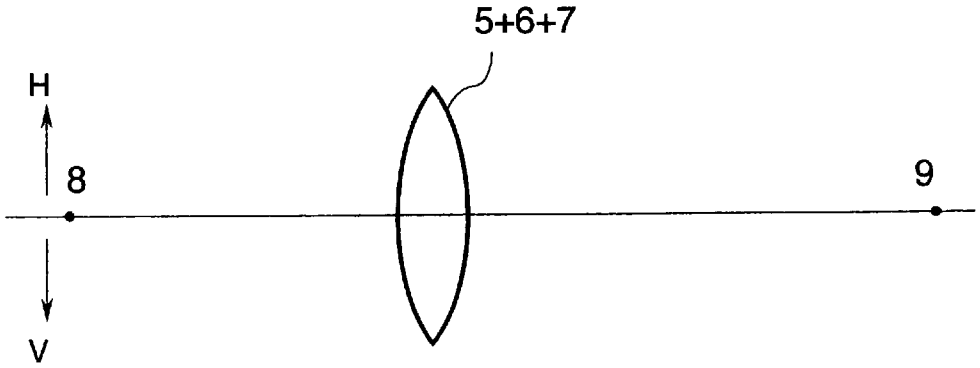

FIG. 4A and FIG. 4B schematically illustrate the function of the quadrupole electromagnets 5 and 6, and the main lens 7*b* of the electron gun. Reference numeral 8 denotes an object point (cathode focal point) of the electron gun), 9 denotes an image point (beam spot on the screen). The arrangement of the two quadrupole electromagnets can be made to have the function of the converging lens both in horizontal and vertical directions, so that the main plane as the converging lens system as a whole can be positioned closer to the screen. The size of the spot on the screen can therefore be made smaller. As a result, the magnification factor between the object point and the image point can be made smaller. In FIG. 4B, the overall function of the three lenses in FIG. 4A is represented by a single lens.

In the present embodiment, the main plane of the converging lens system is made to advance (toward the screen), and the magnification factor is reduced, so that a high resolution can be obtained throughout the screen. Moreover, the quadrupole electromagnets are both driven by a d.c. current, so that the power supply circuit required for the drive can be simplified, and the cost can be lowered.

Embodiment 2

Figure 5A:
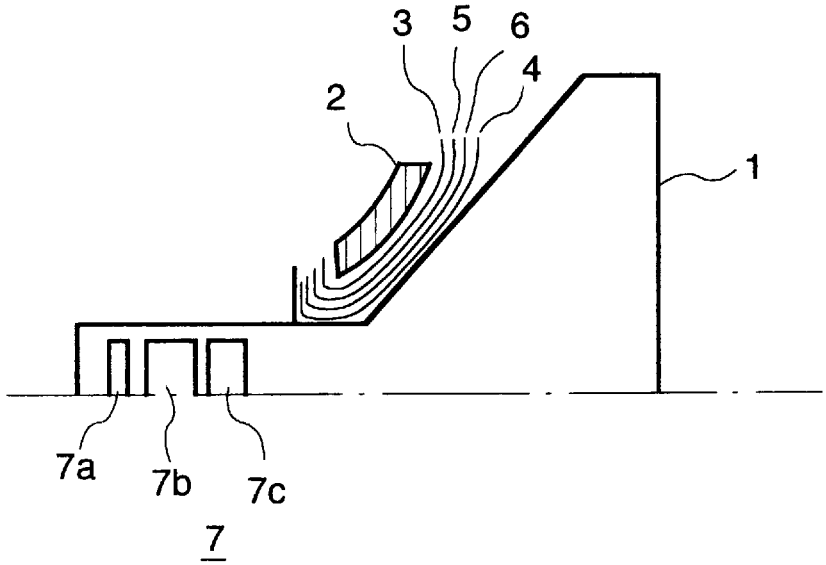
FIG. 5A and FIG. 5B show a second embodiment (Embodiment 2) of the invention.
Figure 5B:
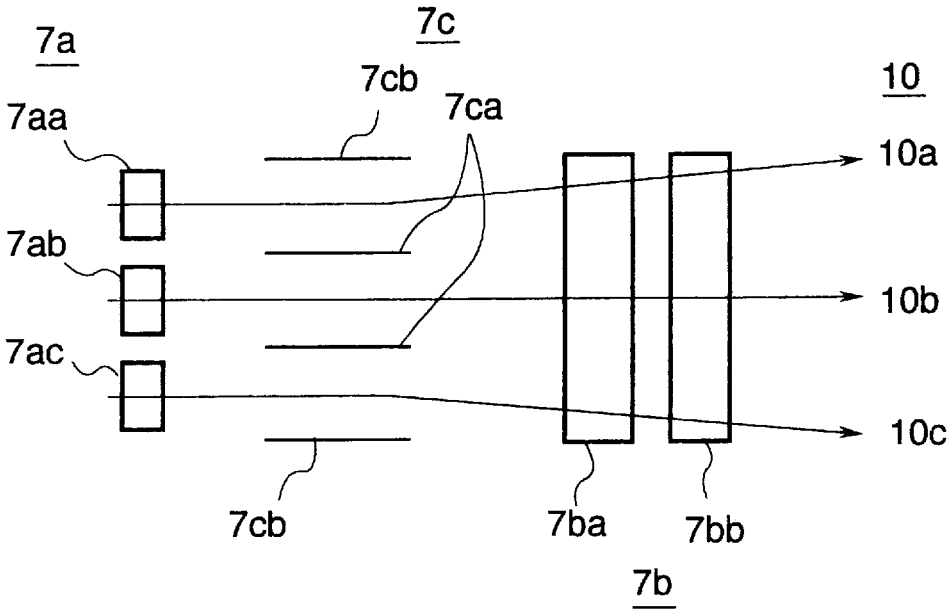
Figure 6A:
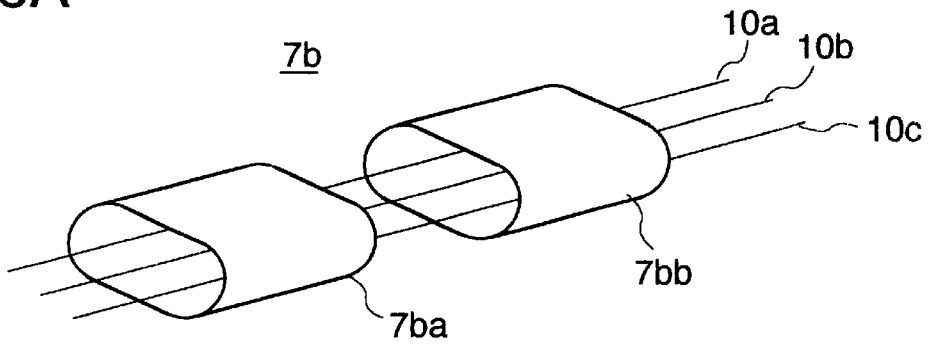
FIG. 6A is a perspective view of a main lens.

FIG. 5A and FIG. 5B show a second embodiment (Embodiment 2) of the invention. FIG. 5A shows the overall configuration. Reference numerals 1 to 6 respectively denote members or parts similar to those in Embodiment 1. In addition to the triode section 7*a* and main lens 7*b*, the electron gun 7 is provided with a deflection electrode 7*c*. The main lens 7*b* has a cross section of a race-track shape, as shown in FIG. 6A.

Figure 6B:
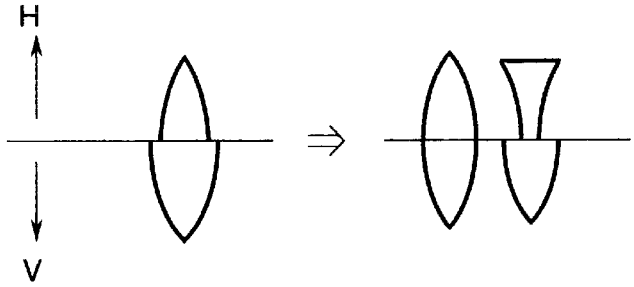
FIG. 6B is a diagram for explaining the function of the main lens with an astigma.
Figure 6C:
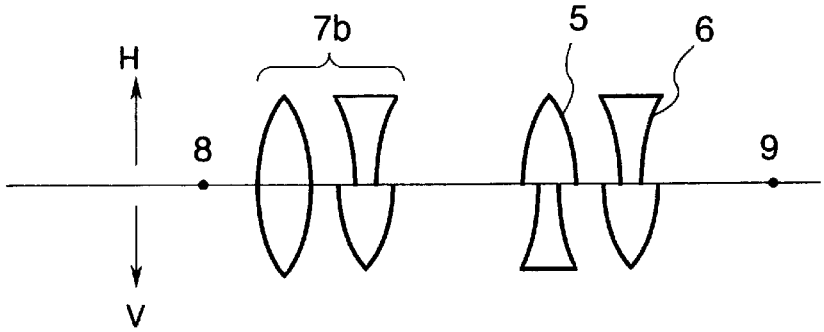
FIG. 6C is a diagram for explaining the function of the main lens and the quadrupole electromagnets.

The main lens with the race-track shape cross section has a strong vertical converging function and a weak horizontal converging function, so that it is associated with an astigma. Such a converging lens is equivalent to a combination of an omnidirectionally uniform converging lens and a quadrupole electric field lens having a horizontally diverging function and a vertically converging function. FIG. 6B is a schematic illustration of such a combination. FIG. 6C is a schematic illustration of the arrangement and functions of the race-track shape main lens 7*b* and the two quadrupole electromagnets 5 and 6 in the deflection yoke. Because the race-track shape main lens 7*b* can be considered as a combination of a converging lens having an omnidirectionally uniform converging function and a quadrupole lens, the arrangement of FIG. 6C can be considered as a combination of a converging lens having an omnidirectionally uniform converging function and three quadrupole lenses. The arrangement of three quadrupole lenses with alternating polarity is called a triplet arrangement in the field of optics. This arrangement can be made to have the converging power which is equal in the horizontal and vertical directions, and the function of correcting the astigma in all directions.

For these reasons, according to the arrangement of the present embodiment, the main plane of the converging lens system can be advanced toward the screen side, by the converging function of the triplet arrangement inherent in the combinatory lens system. As a result, the image magnification factor from the electron gun to the screen can be reduced, and the spot size can therefore be reduced. Moreover, the main lens position in the horizontal direction of the converging lens system and the main lens position in the vertical direction of the converging system are the same, so that the image magnification factors can be made equal between the horizontal and vertical directions, and the desirable spot shape can be obtained. However, the coincidence of the main plane positions in the horizontal and vertical directions need not be accurate. The spot size can be reduced only if the main plane positions for both directions can be advanced. Furthermore, because the triplet arrangement is effectively included, the astigma can be completely corrected in all directions.

The feature of the main lens of the race-track shape is that the dimension in the horizontal direction is large, so that the horizontal converging electric field is highly uniform, and the spherical aberration in the horizontal direction can be reduced by one order. The resolution in the horizontal direction can be substantially improved. Moreover, by modifying the race-track shape, by enlarging both ends of the race-track shape, so that the cross section is rather like a dumbbell-shape, uniformity in the converging function in the beam passage region can be further improved.

Figure 6D:
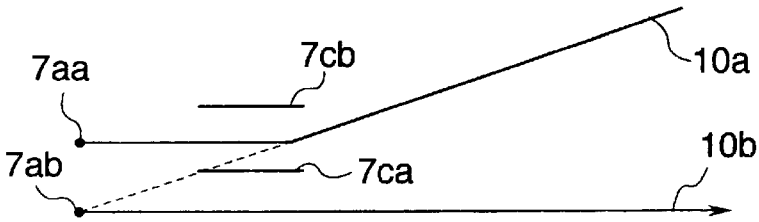
FIG. 6D shows the function of the deflection yoke.

FIG. 6D shows the function of the deflection yoke 7*c*. The magnitude of the deflection angle by the deflection electrode is set so that the virtual image position of the cathode focal point (crossover) of each both side beam coincide with the cathode focal point position of the center beam. The result is as if the three beams originated from the same single cathode, so that if the focusing conditions are satisfied in the subsequent lens systems, the convergence conditions are also satisfied.

In the present embodiment as well, the quadrupole electromagnets are driven by a d.c. current, and an inexpensive drive power supply suffice.

Embodiment 3

FIG. 7A to FIG. 7D show the configuration of a third embodiment (Embodiment 3) of the present invention. The configuration of this embodiment differs from that of Embodiment 2 in the provision of a countermeasure against the astigma associating the deflection electrode 7*c* in Embodiment 2.

The astigma due to the deflection yoke 7*c* occurs only on the side beams and not the center beam. It is therefore not possible to correct it by a single action exerted both on the side beams and center beams. It is therefore necessary to add astigma only to the side beams for the correction.

Figure 7A:
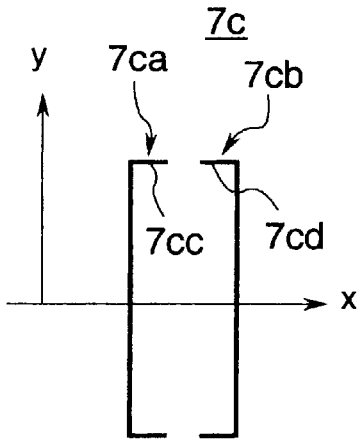
FIG. 7A shows the arrangement of the deflection electrodes according to a third embodiment (Embodiment 3) of the invention.
Figure 7B:
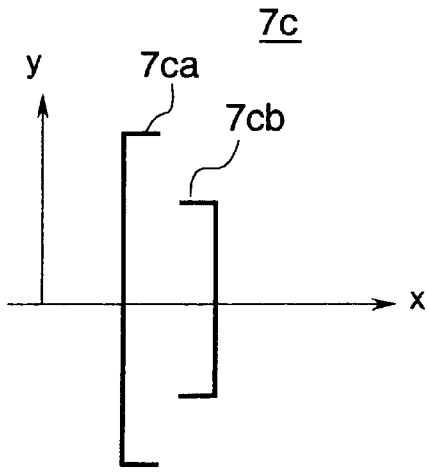
FIG. 7B shows a variation of the arrangement of the deflection electrodes in Embodiment 3.

FIG. 7A shows the arrangement in which the shape of the deflection electrodes 7*ca* and 7*cb* is such (having the bent portions 7*cc* and 7*cd*) as to produce an astigma in the direction opposite to the direction of the astigma generated by the deflection of the side beams. The astigma of the side beams is corrected by the deflection electrode itself. The arrangement shown in FIG. 7B, in which the height of the electrode 7*ca* and the height of the electrode 7*cb* are different from each other produces similar function (producing a stronger astigma).

Figure 7C:
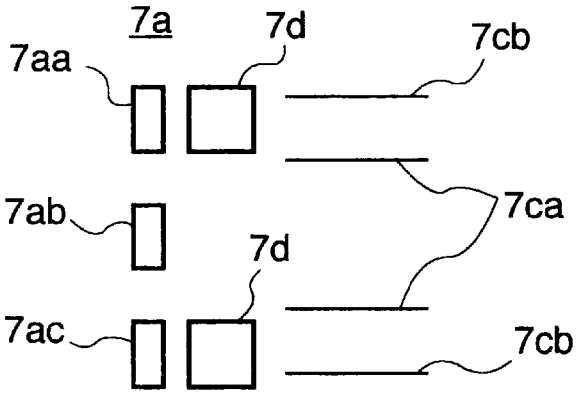
FIG. 7C shows another arrangement for correcting the astigma of the side beams.

FIG. 7C shows another arrangement for correcting the astigma of the side beams. A quadrupole electric field lens 7*d* is provided only for the side beams immediately before or immediately after the deflection electrode. The quadrupole electric lens 7*d* can correct the astigma of the side beams.

Figure 7D:
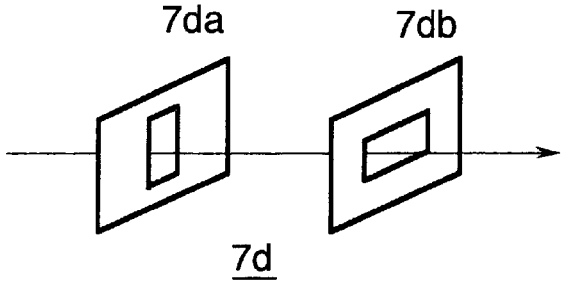
FIG. 7D shows another arrangement of the quadrupole electric field lens.

As shown in FIG. 7D, the quadrupole electric field lens 7*d* may comprise first and second electrodes having apertures elongated in vertical and horizontal directions, respectively.

Figure 8A:
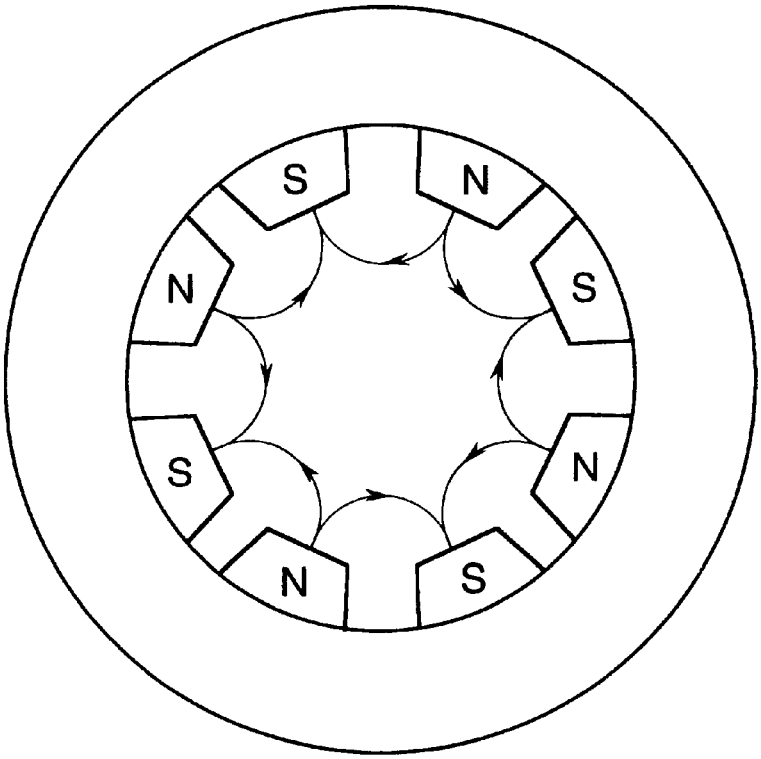
FIG. 8A and FIG. 8B show another arrangement for correcting astigma of the side beams.
Figure 8B:
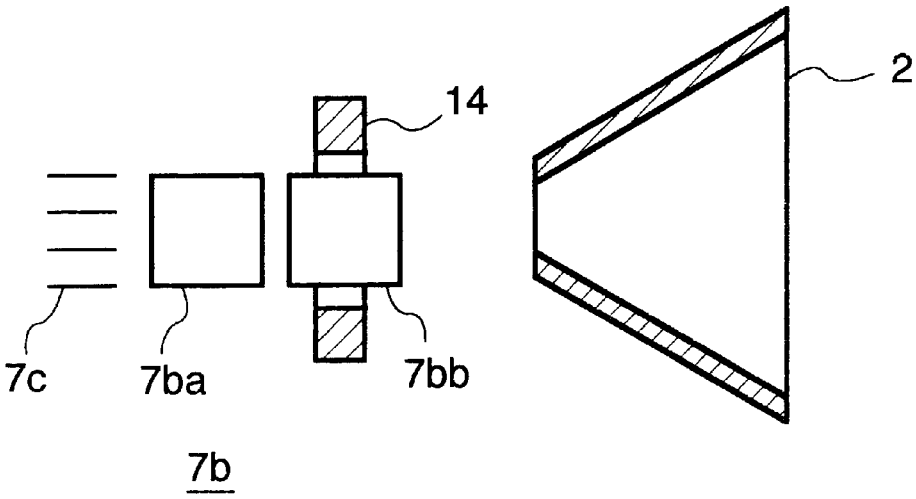

FIG. 8A and FIG. 8B show another arrangement for correcting astigma of the side beams. Reference numeral 14 denotes an 8-pole electromagnet. FIG. 8A shows the structure of the 8-pole electromagnet and the magnetic field generated thereby. FIG. 8B shows an example of arrangement of the 8-pole electromagnet 14. Reference numeral 2 denotes the deflection yoke, 7*b* denotes a main lens of the race-track shape, 7*c* denotes a deflection electrode. The 8-pole electromagnet 14 is provided in the vicinity of the main lens 7*b*.

The 8-pole electromagnet has the function of correcting the astigma only at a position far away from the central axis of the beam, so that it corrects the astigma associating only with the side beams.

Embodiment 4

Figure 9A:
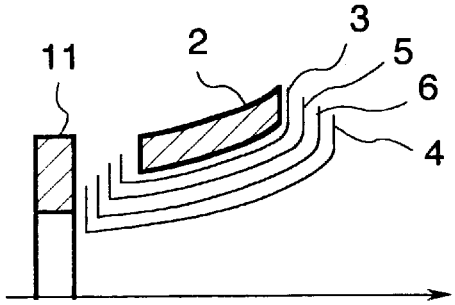
FIG. 9A shows the overall configuration of a fourth embodiment (Embodiment 4) of the invention.
Figure 9B:
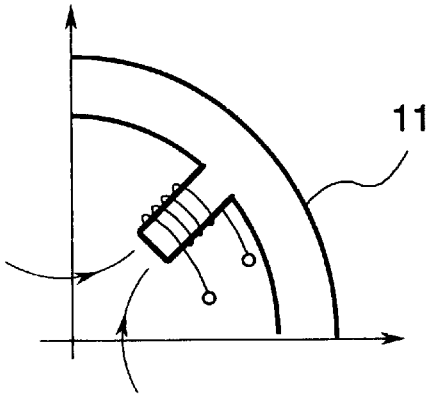
FIG. 9B shows an example of the configuration of the quadrupole electromagnet and the shape of the magnetic field.
Figure 9C:
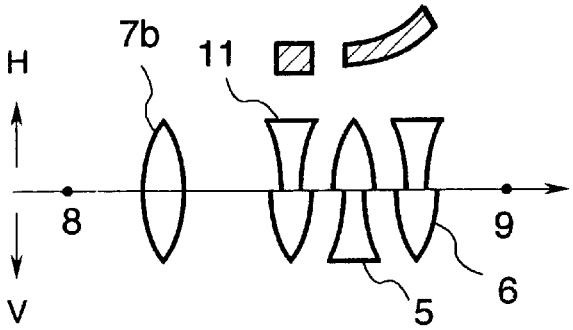
FIG. 9C shows the arrangement with three quadrupole lenses.

FIG. 9A to FIG. 9C show the configuration of a fourth embodiment (Embodiment 4) of the invention. FIG. 9A shows the overall configuration. Reference numerals 1 to 7 denote members or parts similar to those in Embodiment 1. The present embodiment differs from Embodiment 1 in the provision of a quadrupole electromagnet 11 having a sub yoke at the neck part of the deflection yoke. FIG. 9B shows an example of the configuration of the quadrupole electromagnet and the shape of the magnetic field generated thereby.

In the illustrated configuration, in addition to the two quadrupole electromagnets 5 and 6 of the deflection yoke forming the doublet arrangement, the third quadrupole electromagnet 11 is provided. By having the three quadrupole electromagnets with their polarity being alternated, the triplet arrangement can be realized. FIG. 9C shows the arrangement with three quadrupole lenses 5, 6 and 11. In the figures, reference numeral 7*b* shows the function of the main lens of the electron gun. In the present embodiment, the quadrupole lenses 5, 6 and 11 forms a triplet arrangement, so that it is not necessary for the main lens to generate an astigma.

In the present embodiment, the triplet arrangement can be made to have the beam converging function to advance the main plane of the converging lens system toward the screen side, thereby reducing the image magnification factor and reducing the spot size. Moreover, the main plane position of the converging lens system in the horizontal direction and the main plane position of the converging lens system in the vertical direction can be made to coincide, so that the image magnification factor can be made equal, and a desirable spot shape can be obtained. Furthermore, an astigma can be corrected in all directions.

The sub yoke 11 of the quadrupole electromagnet in the present embodiment can be used in place of one of the two sets of quadrupole electromagnets 5 and 6 in Embodiment 1 to 3.

Figure 10:
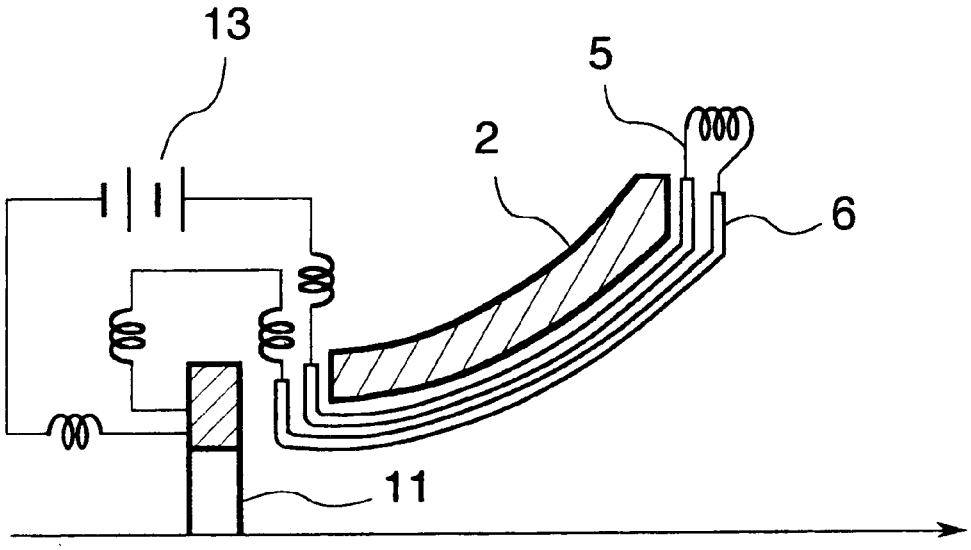
FIG. 10 shows a configuration in which the three electromagnets are driven by a single d.c. power supply.

Also in the present embodiment, the quadrupole electromagnets are all driven by a d.c. current, so that a d.c. power supply, which is inexpensive, can be used. FIG. 10 shows a configuration in which the three electromagnets 5, 6 and 11 are driven by one d.c. power supply. The use of the single d.c. power supply means that the same current flows through the three coils, but the magnetic field strength and hence the deflection function can be adjusted by appropriate selection of the number of turns of windings. By adopting the manner of drive described above, economical deflection system can be realized.

Figure 11A:
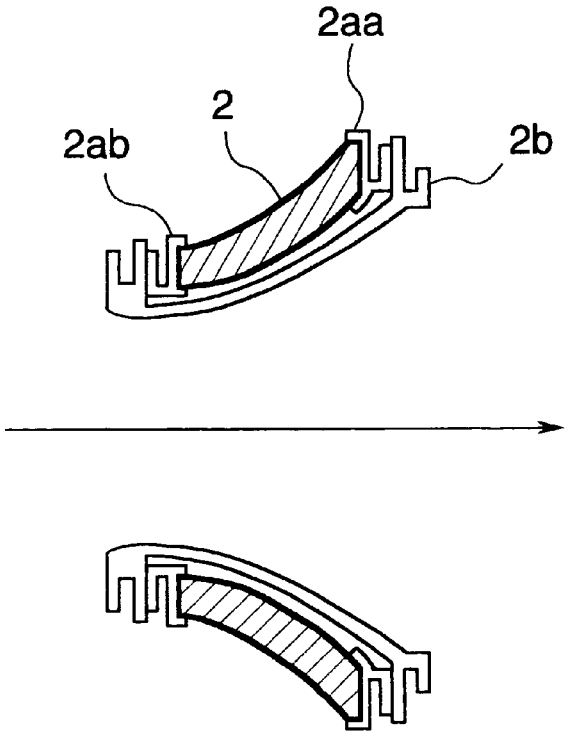
FIG. 11A and FIG. 11B show the configuration of quadrupole electromagnet coils in the deflection yoke.
Figure 11B:
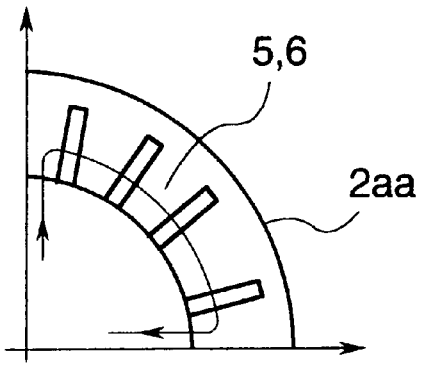

FIG. 11A and FIG. 11B show the manner of configuring the quadrupole electromagnet coils in the deflection yoke. FIG. 11A shows the typical shapes of the deflection yoke coil bobbin for the deflection yoke. Reference numeral 2*aa* and 2*ab* denote bobbins for the vertical deflection coil, and 2*b* denotes a bobbin for the horizontal deflection coil. Providing separate bobbins for the quadrupole magnetic coils 5 and 6 will increase the inner diameter of the deflection yoke core, and will reduce the generated magnetic field strength. Because the voltage applied to the horizontal deflection coil is high, winding the quadrupole electromagnet coil of a low d.c. voltage on the same bobbin will require an additional electric insulating layer and bring about a problem of space similar to that described above. In the present embodiment, the quadrupole electromagnet coil is wound on the bobbins 2*aa* and 2*ab* which are for the vertical deflection coil. Both coils are driven by a low voltage, so that additional insulating layer is not required, and can be wound on the same bobbin. No additional space is required, and the reduction in performance of each coil can be avoided.

Embodiment 5

Figure 12A:
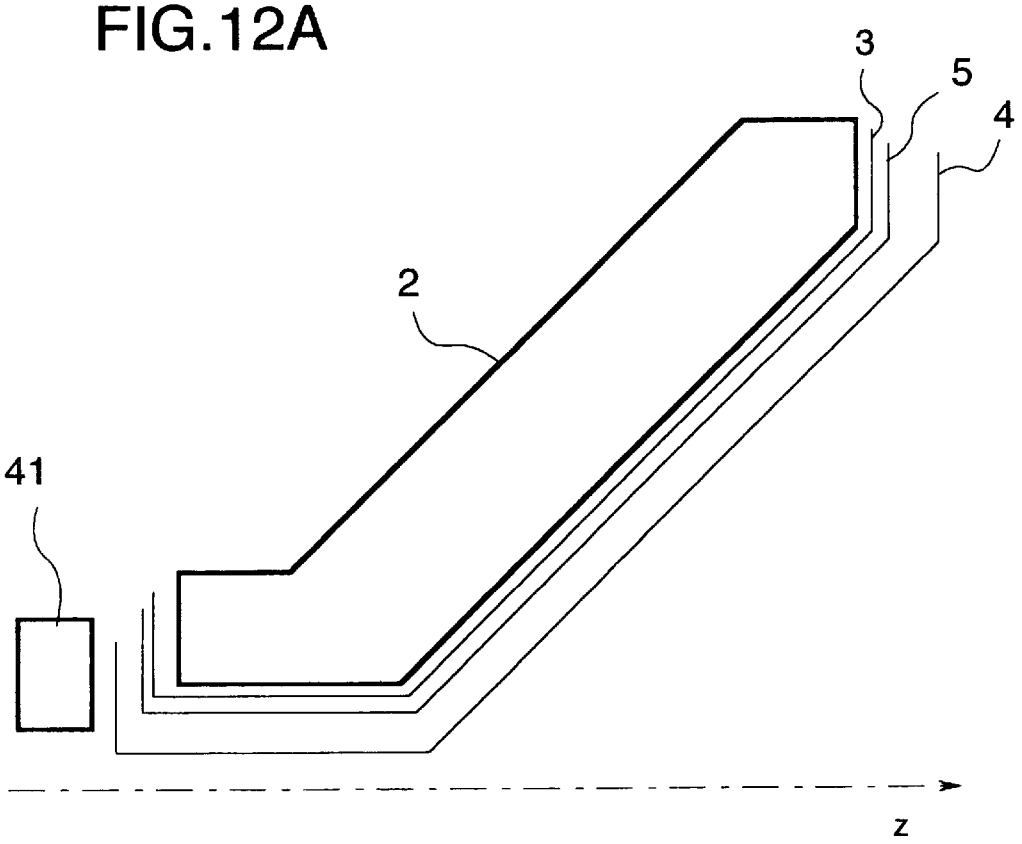
FIG. 12A and FIG. 12B show a fifth embodiment (Embodiment 5) of the invention.
Figure 12B:
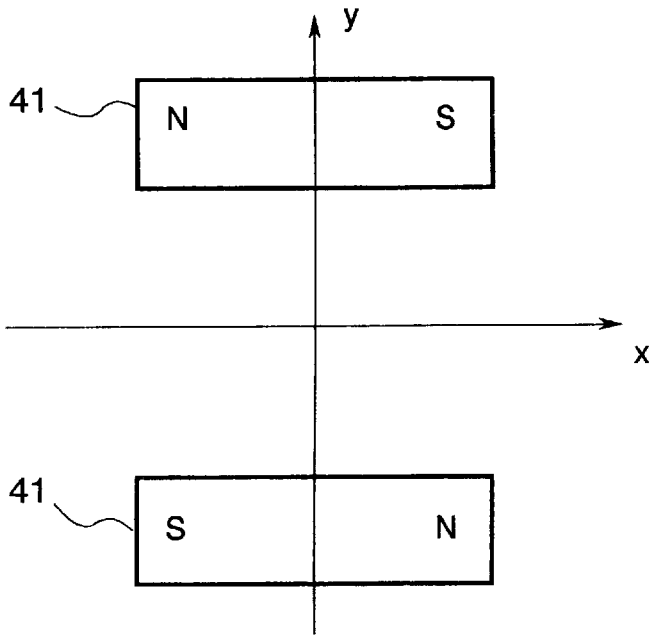

FIG. 12A and FIG. 12B show a fifth embodiment (Embodiment 5) of the invention. FIG. 12A shows the overall configuration. Reference numeral 41 denotes a permanent magnet in the shape of a rectangular parallelepiped provided at the neck part of the deflection yoke. FIG. 12B is a view of part of the permanent magnet 41 as seen in the direction the z-axis.

The permanent magnet 41 used in place of the quadrupole electromagnet 11 having a sub yoke will produce a result similar to that of Embodiment 4.

In FIG. 12, the quadrupole electromagnets 6 and the permanent magnet 41 form the doublet arrangement. By adding a quadrupole of the deflection yoke, a triplet arrangement can be formed.

Embodiment 6

Figure 13A:
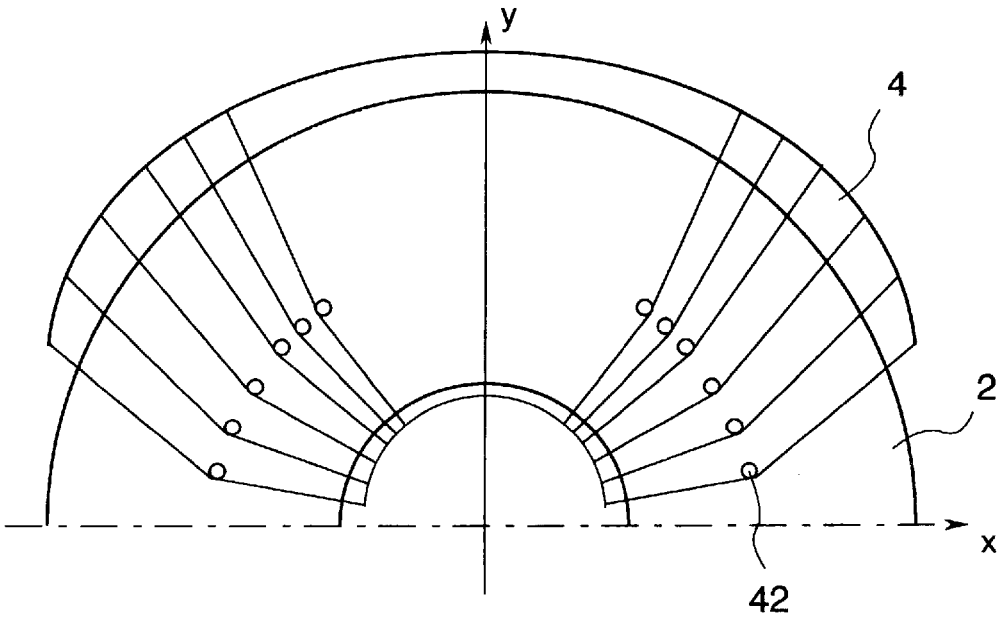
FIG. 13A and FIG. 13B show a sixth embodiment (Embodiment 6) of the invention.
Figure 13B:
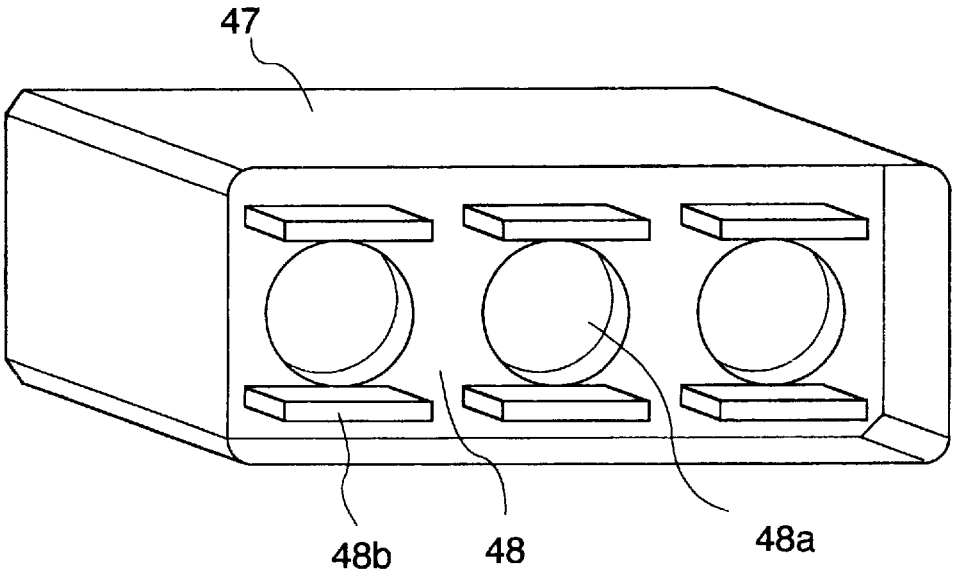

FIG. 13A and FIG. 13B show a sixth embodiment (Embodiment 6) of the invention. FIG. 13A is a view of the deflection yoke as seen from the screen side. FIG. 13B shows an electrode to which a low voltage is applied, i.e., the low-voltage side electrode, in the electrode part forming the main lens of the electron gun.

In FIG. 13A, reference numeral 42 denotes a winding guide, which is attached to the bobbin for the horizontal deflection coil so that it is positioned in the middle of the deflection yoke. By virtue of the winding guide 42, the horizontal deflection coil 4 is wound such that it is bent (with a certain angle) at a point intermediate between the neck part and the screen.

The coil distribution and pincushion and barrel magnetic fields will next be described. Distribution of the magnetic lines of force in the pincushion and barrel magnetic fields are respectively shown in FIG. 14A and FIG. 14B. In the pincushion magnetic field, the magnetic field is increased with the distance from the central axis, as shown in FIG.

14A. In the barrel magnetic field, the magnetic field is decreased with the distance from the central axis, as shown in FIG. 14B. Accordingly, the pincushion magnetic field acts as a horizontally diverging and vertically converging lens. The barrel magnetic field on the other hand acts as a horizontally converging and vertically diverging lens.

Figure 14A:
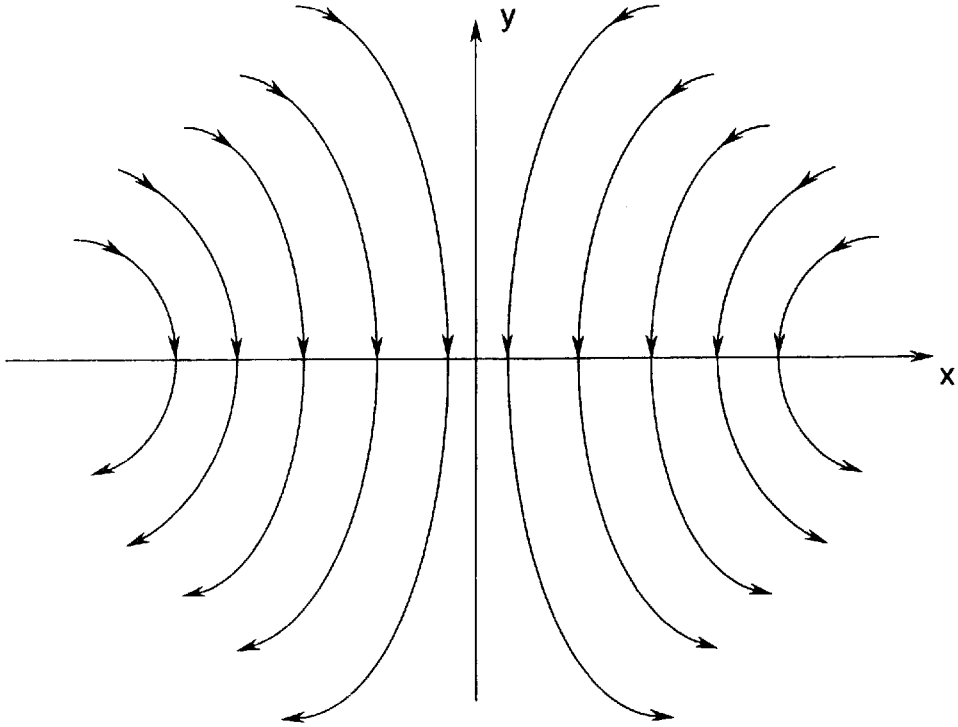
FIG. 14A and FIG. 14B show distribution of the lines of force in the pincushion and barrel magnetic fields.
Figure 14B:
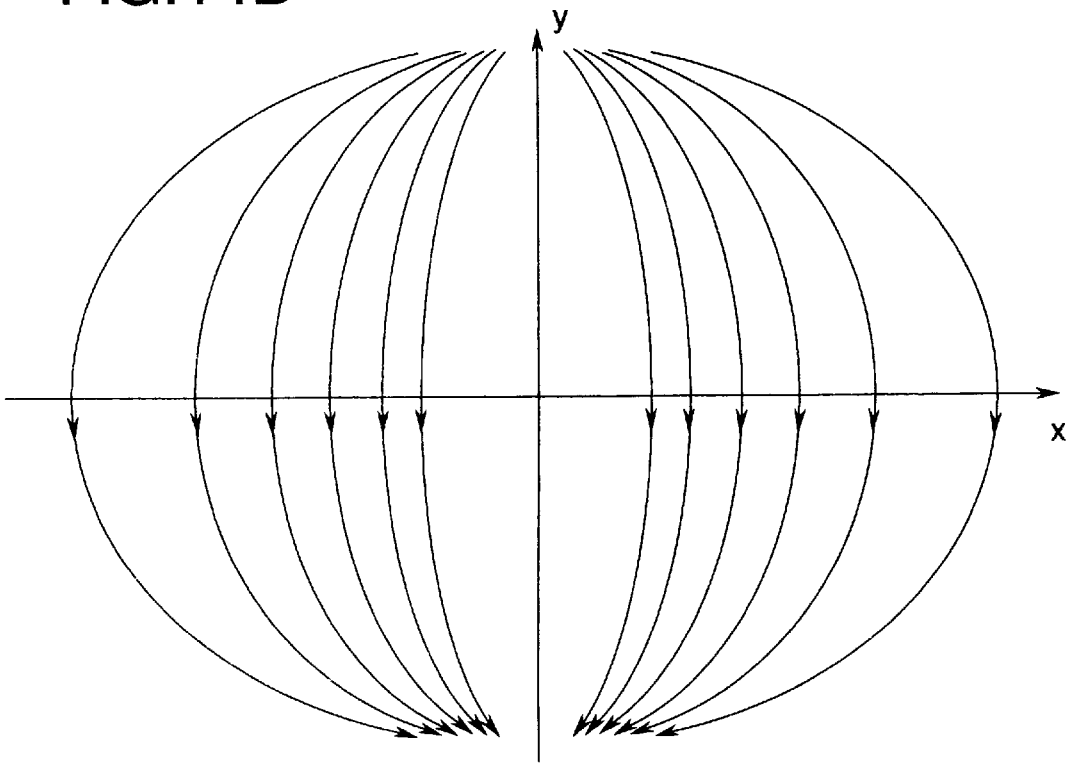

As will be expected from FIG. 14A and FIG. 14B, coils should be concentrated on the horizontal plane to produce the pincushion magnetic field, and coils should be provided away from the horizontal plane, e.g., at about positions 60 degrees with respect to the horizontal plane, to produce the barrel magnetic field.

The deflection yoke according to the present embodiment shown in FIG. 13A has its coil disposed at a smaller angle (with respect to the horizontal plane) at the central part of the deflection yoke (at a position closer to the neck of the CRT), and disposed at a larger angle (with respect to the horizontal plane) at a position closer to the screen. Accordingly, at the central part of the deflection yoke, a stronger pincushion magnetic field is generated, while in the vicinity of exit of the deflection yoke (closer to the screen) the barrel magnetic field is stronger.

It is possible to appropriately select the distribution of the winding from the neck part to the screen side of the core in the deflection yoke, to produce the pincushion magnetic field.

Also, by producing the barrel magnetic field, the deflection yoke as a whole can produce a magnetic field comprising a barrel-shaped field part, pincushion-shaped field part, and barrel-shaped field, arranged along the axis of the CRT, from the neck part toward the screen.

The configuration of the electron gun will next be described with reference to FIG. 13B. The electrostatic lens forming the main lens of the electron gun comprises a low voltage electrode and a high voltage electrode, which are provided in confrontation with each other. The low-voltage electrode comprises, as shown in FIG. 13B, a cylindrical electrode 47 with it inner cross section of a race-track shape, and a metal plate 48 provided inside the cylindrical electrode 47 and provided with three apertures 48*a* for the three electron beams. A projecting flat electrode 48*b* is provided above and below each aperture 48*a*, as is also shown in FIG. 13B.

The high-voltage electrode may be similar to the low voltage electrode, but the projecting flat electrode 48*b* may be omitted.

In the illustrated example, the projecting flat electrodes 48*b* are provided for the respective apertures 48*a*, separately. However, the three projecting flat electrodes 48*b* above the three apertures 48*a* may be connected to each other to form a single elongated electrode, and similarly, the three projecting flat electrodes 48*b* below the three apertures 48*a* may be connected to each other to form a single elongated electrode.

In the electron gun having the electrode configuration described above, the electric lines force tend to concentrate at and near the projecting flat electrodes 48*b*. This means that the lens has the vertically converging power stronger than the horizontally converging power.

As a result, it is possible for the electron gun to have an astigmatism. By appropriately adjusting the shape of the apertures 48*a*, the width and height of the projecting flat electrodes 48*b*, and the strength of the astigmatism can be adjusted.

Figure 15A:
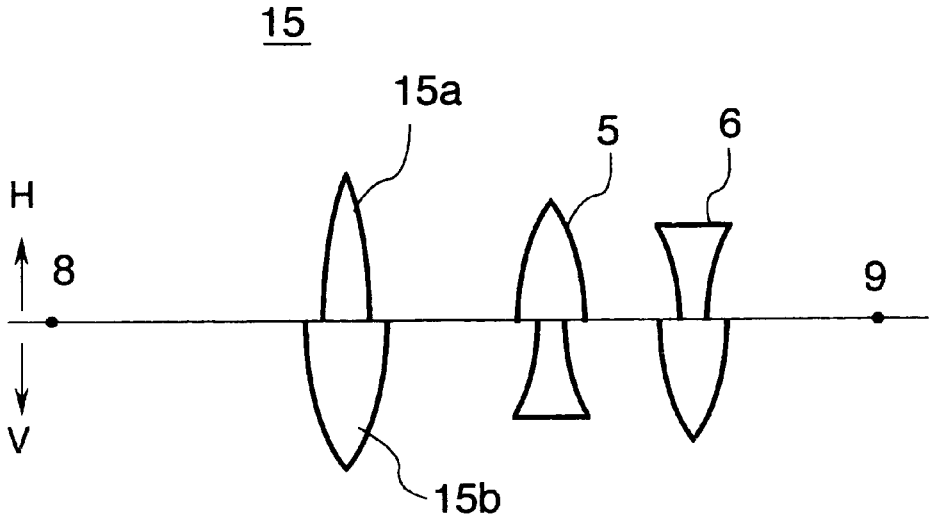
FIG. 15A and FIG. 15B schematically illustrates the lens effect produced by the quadrupole magnetic field generated when a d.c. current is made to flow.

FIG. 15A schematically illustrates the lens effect produced by the quadrupole magnetic field generated when a d.c. current is made to flow. The two quadrupole lenses may be formed of the quadrupole electromagnet coils 5 and 6 of Embodiment 1, or of any other configuration described in connection with any of Embodiments 2 to 5. In the figure, reference numeral 5 denotes the lens function due to the coil generating a strong quadrupole magnetic field on the neck side, and 6 denotes the lens function due to the coil generating the strong quadrupole magnetic field on the screen side.

In this way, the combination of the two quadrupole lenses by themselves produces an astigma. For this reason, the electron gun is made to have a converging power with an astigma, shown in FIG. 13B. This is schematically illustrated by the lenses 15*a* and 15*b*. These lenses are equivalent to a combination of a converging lens having a uniform converging power in all directions, and a quadrupole electric field lens having a converging function in the horizontal direction, described in connection with Embodiment 2 with reference to FIG. 6B. Thus, the overall configuration is considered to include the triplet arrangement shown in FIG. 6C. By making the triplet arrangement have the beam converging power, the main plane of the converging lens system can be advanced toward the screen, thereby reducing the image magnification factor and reducing the spot size. Moreover the main plane position of the converging lens system can be made identical between the horizontal and vertical directions, and the image magnification factor can be made the same, and the spot shape can be made desirable. Furthermore, the astigma can be corrected properly in all directions.

Figure 15B:
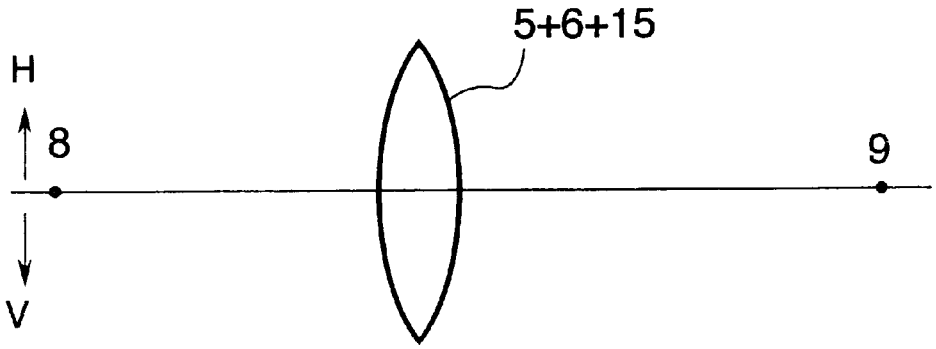

That is, as shown in FIG. 15A, the system is formed of three lenses. The freedom consists of two degrees of freedom in the converging power of the electron gun, two degrees of freedom in the converging power of the quadrupole magnetic field, i.e., four degrees in all. Accordingly, by using any of the lens strengths of the electron gun and the quadrupole magnetic field, it is possible to obtain focusing in the horizontal and vertical directions at the center of the screen, and to obtain satisfactory roundness of the beam at the center of the screen, and yet one degree of freedom is spared. FIG. 15B shows this. It is possible to make the horizontal and vertical main planes coincident.

Next, the situation where the electron beam is deflected to the peripheral portion will be discussed.

The deflection coil (horizontal coil 4) for deflecting the beam to the peripheral portion has the configuration shown in FIG. 13A, where the distribution of the windings is varied along the axis of the CRT. That is, it produces the barrel-pincushion-barrel magnetic field distribution from the neck side to the screen side. The pincushion magnetic field has the horizontally diverging effect, and the barrel magnetic field has the horizontally converging effect. The first barrel magnetic field does not have a substantial contribution to convergence, as described in connection with the prior art example, so that description of its function as the lens is omitted here.

Figure 16A:
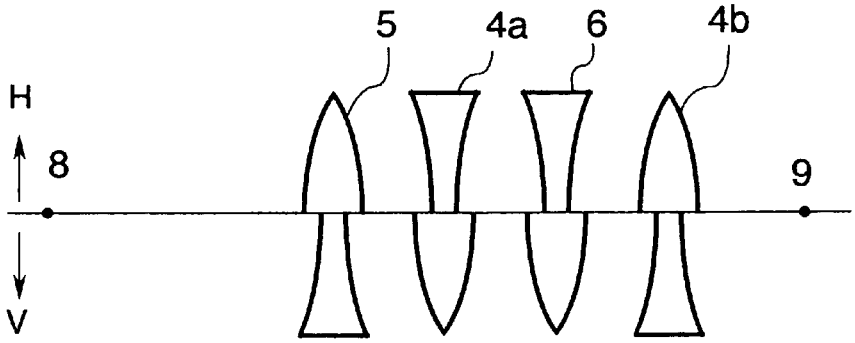
FIG. 16A to FIG. 16C show the quadrupole lens effects of the pincushion magnetic field and second barrel magnetic field, in combination with the lens effects of the quadrupole electromagnetic coils and the electron gun.
Figure 16B:
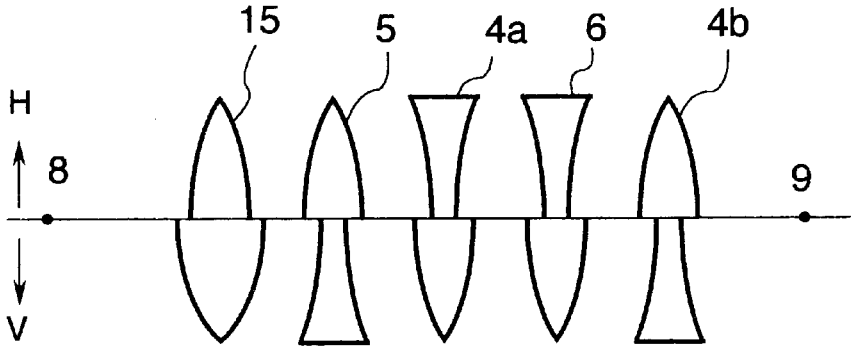
Figure 16C:
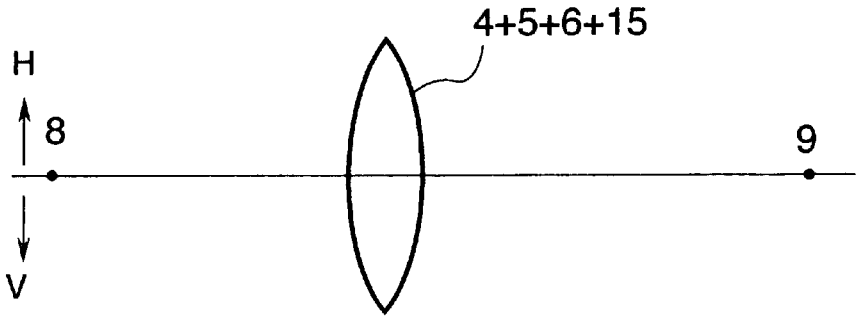

Reference numerals 4*a* and 4*b* shown in FIG. 16A to FIG. 16C show the quadrupole lens effect due to the abovementioned pincushion magnetic field, and second barrel magnetic field. The degree of freedom of the lenses are as follows. As described above, the strength of any of the lenses 5 and 6, and the strength of the lenses 4*a* and 4*b* can be selected freely. The requirements on the deflection yoke are (1) the magnetic field must be such that the three beams must converge on the screen, (2) the focusing in the vertical direction must be achieved, (3) the roundness (ratio between the horizontal and vertical dimensions of the beam) must be improved.

Because the electromagnet has three degrees of freedom, while there are three items of restraint, a satisfactory solution can be obtained.

Moreover, because the lens system is present near the screen as described above, the shape of the spot is improved compared with the conventional system.

As has been described, it is possible to satisfy the focus characteristics in horizontal and vertical directions, without changing the lens strength of the electron gun, even when the beam is deflected to the peripheral part of the screen.

Embodiment 7

Figure 17A:
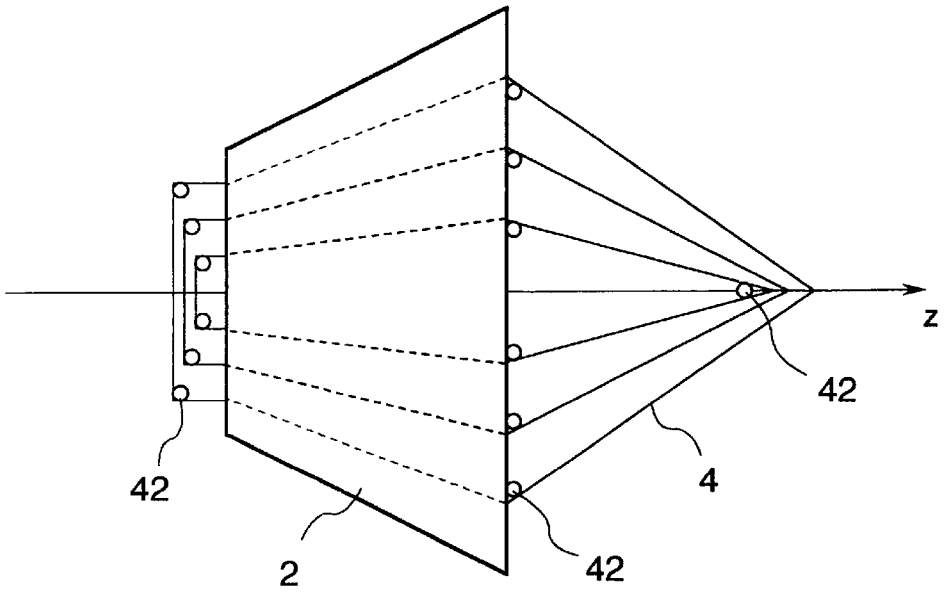
FIG. 17A and FIG. 17B show the configuration of a seventh embodiment (Embodiment 7) of the invention.
Figure 17B:
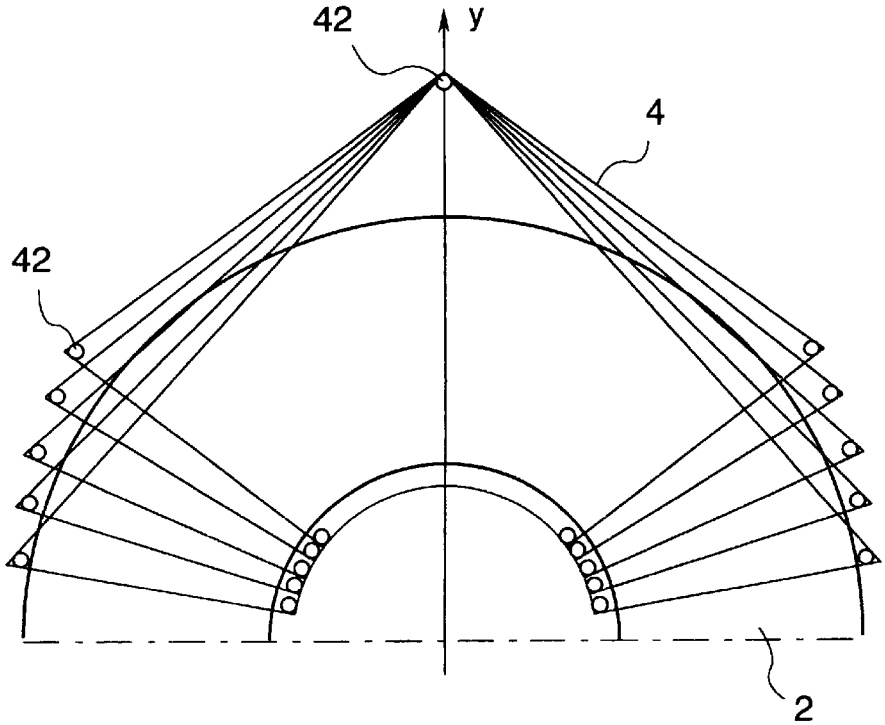

FIG. 17A and FIG. 17B show a seventh embodiment (Embodiment 7) of the invention. This is another arrangement wherein the magnetic field generated by the deflection yoke has a barrel-pincushion-barrel configuration in the sequence from the neck part toward the screen. FIG. 17A is a view of the deflection yoke as seen in the vertical direction. FIG. 17B is a view as seen from the screen side. As illustrated, winding guide 42 is provided at the neck part and on the screen side, and the part of the bridging parts of the horizontal deflection coil intersecting the y-z plane is protruding toward the screen.

With such a configuration, the winding is at a position with a greater angle with respect to the horizontal plane (x-z plane) in the vicinity of the exit of the deflection yoke. Accordingly, a barrel magnetic field is generated in this region.

If the windings are concentrated in the positions with small angles with respect to the horizontal plane, the pincushion magnetic field is generated.

It is also possible to generate the barrel magnetic field at the neck part of the deflection yoke.

As a result, it is possible to form barrel-pincushion-barrel magnetic field, as will be apparent from the description of Embodiment 6.

Embodiment 8

Figure 18A:
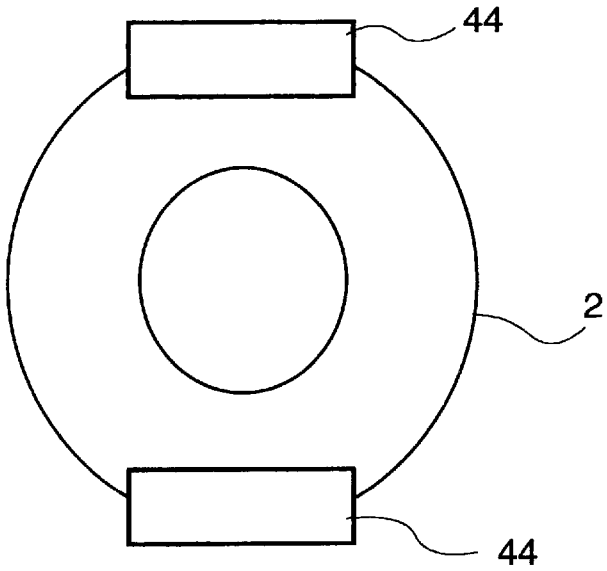
FIG. 18A and FIG. 18B show the configuration of an eighth embodiment (Embodiment 8)
Figure 18B:
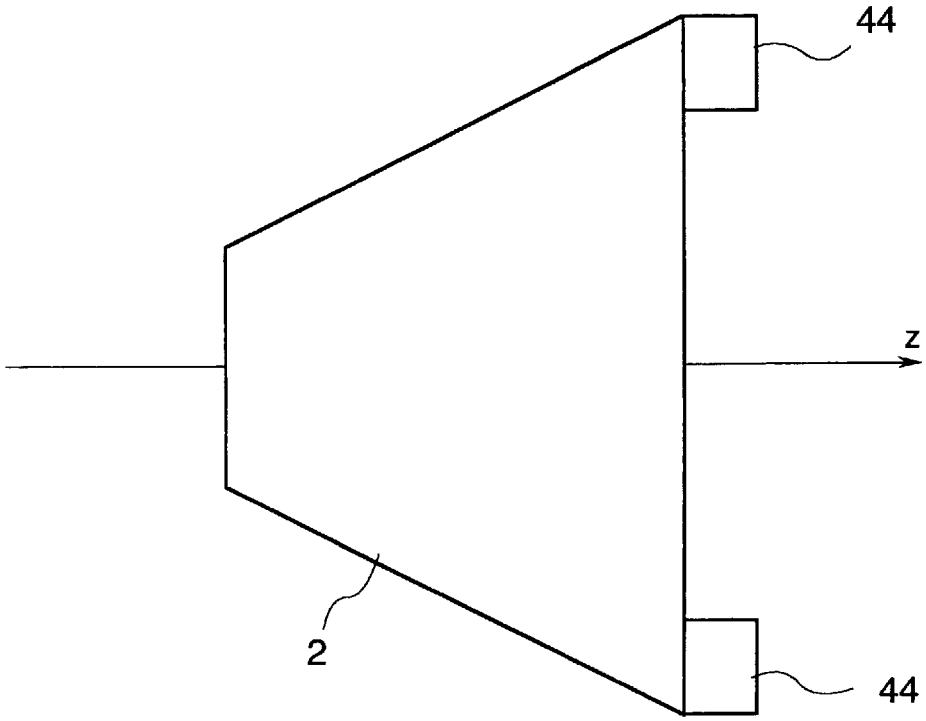

FIG. 18A and FIG. 18B show an eighth embodiment (Embodiment 8). This is a further arrangement wherein the magnetic field generated by the deflection yoke has a barrel-pincushion-barrel configuration from the neck part toward the screen. FIG. 18A is a view of the deflection yoke as seen from the screen side. FIG. 18B is a side view. In the figure, reference numeral 44 denotes magnetic bodies disposed in the vicinity of the exit of the deflection yoke, and at an upper and lower part, being symmetrical with each other. The magnetic core 2 effectively protrudes sideways (both rightward and leftward) at the top and bottom parts, because of the magnetic bodies 44.

Figure 19A:
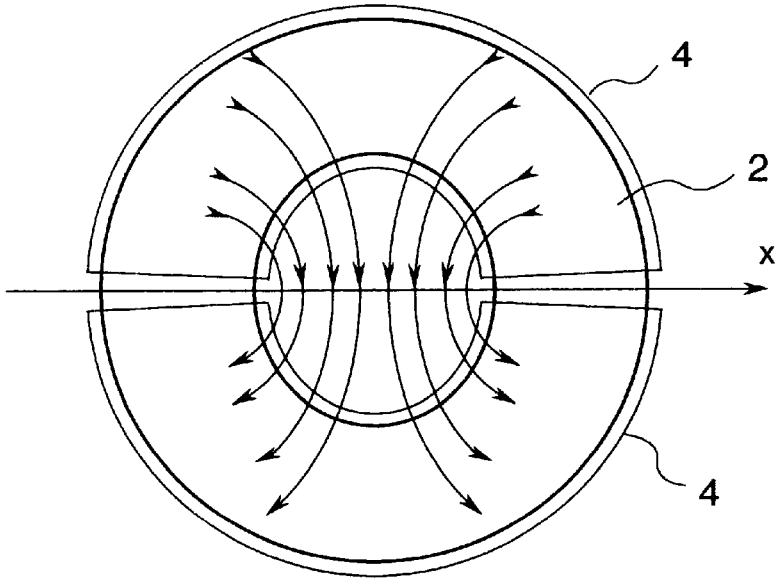
FIG. 19A and FIG. 19B show the magnetic lines of force with and without magnetic bodies in Embodiment 8.
Figure 19B:
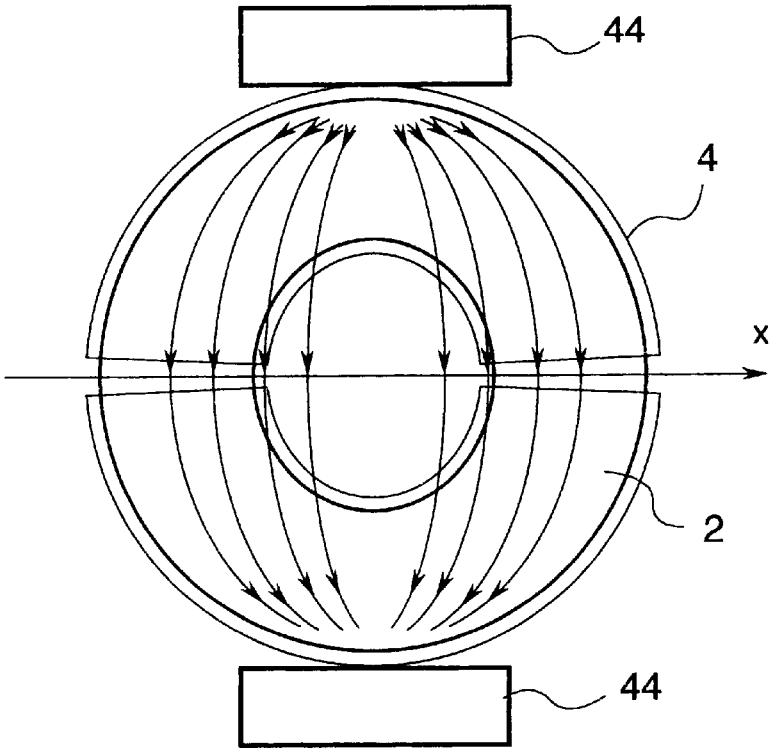

FIG. 19A and FIG. 19B show the magnetic lines of force. FIG. 19A shows the magnetic lines of force when the magnetic bodies 44 are not present, whereas FIG. 19B shows the magnetic lines of force when the magnetic bodies 44 are present.

The magnetic field generated by the deflection yoke is generally of a pincushion configuration on the screen side, i.e., in the vicinity of the exit, as was described in connection with the prior art (FIG. 19A). In the present embodiment, however, the magnetic bodies 44 are disposed at the upper and lower parts, in the vicinity of the exit, so that the horizontal deflection magnetic field is concentrated at the magnetic bodies 44 (FIG. 19B). This means the magnetic field is increased along the y axis with the distance from the central axis, and the magnetic field is of the barrel configuration.

By disposing the magnetic bodies at the upper and lower parts in the vicinity of the exit of the deflection yoke, the magnetic field, which otherwise is pincushion-shaped, is changed to barrel-shaped. By appropriately selecting the number and distribution of the windings of the deflection yoke, it is possible to obtain the barrel-pincushion-barrel configuration from the neck part toward the screen.

In Embodiment 8, the magnetic bodies 44 are disposed to effectively produce portions protruding in the right and left directions. As an alternative, cut-away parts may be formed in the right and left of the magnetic core 2, and yet similar effects are obtained.

Embodiment 9

Figure 20:
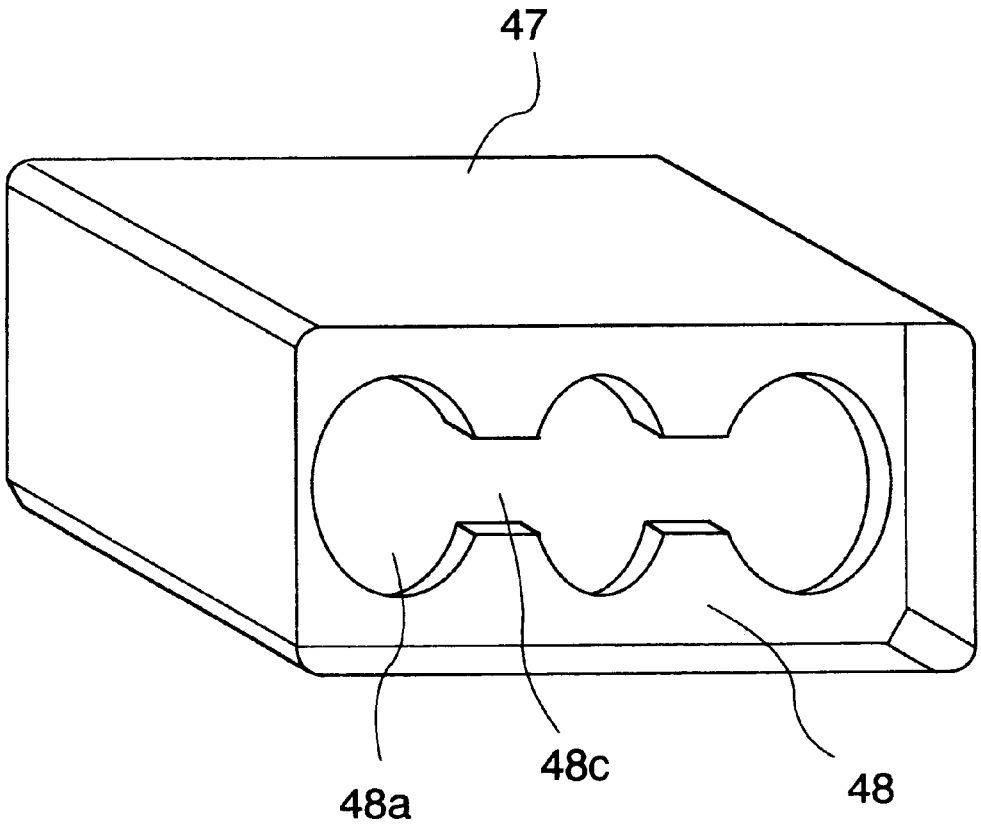
FIG. 20 shows the configuration of a ninth embodiment (Embodiment 9) of the invention.

Another configuration for realizing an electron gun with an astigma will next be described with reference to FIG. 20, which shows the configuration of a ninth embodiment (Embodiment 9) of the invention. FIG. 20 shows the low voltage electrode in the electrode section forming the main lens of the electron gun. The electrostatic lens forming the main lens of the electron gun comprises a low voltage electrode and a high voltage electrode, which are provided in confrontation with each other. The low-voltage electrode comprises, as shown in FIG. 20, a cylindrical electrode 47 with it inner cross section of a race-track shape, and a metal plate 48 provided inside the cylindrical electrode 47 and provided with three apertures 48*a* for the three electron beams. The three apertures 48*a* are communicated with each other via slits 48*c* having a width smaller than the diameter of the apertures 48*a*. The high-voltage electrode may also be provided with similar slits.

The operation of the electron gun having the above electrode configuration will next be described. The apertures with the slits provide effects equivalent to apertures being elongated horizontally. In such a case, there will be a difference in the converging power between the horizontal and vertical directions. The vertically converging power is stronger than the horizontally converging power.

As a result, it is possible to impart astigma to the electron gun. By appropriately selecting the width of the slits 48*c* and the shape of the apertures, the strength of the astigma can be adjusted.

Embodiment 10

Figure 21A:
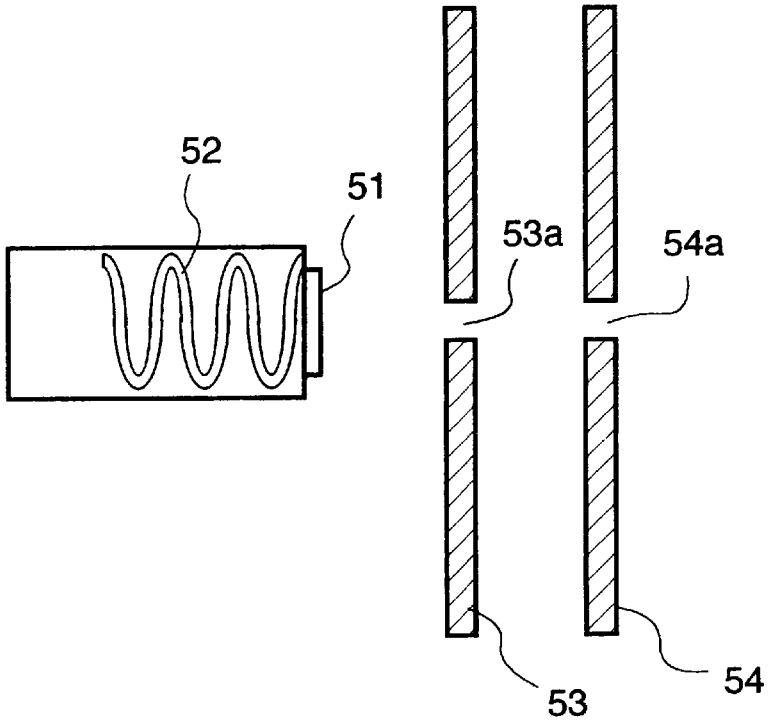
FIG. 21A shows the configuration of the triode section of an electron gun.
Figure 21B:
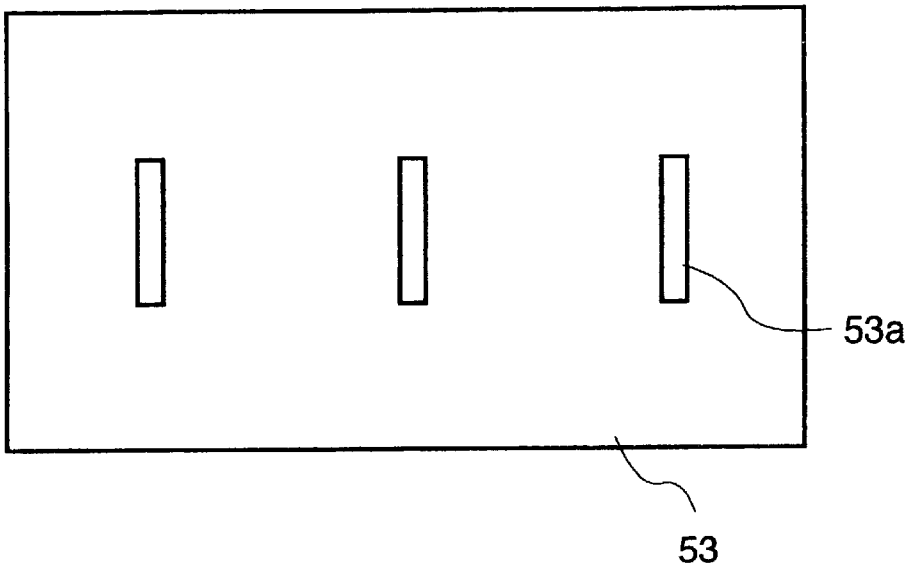
FIG. 21B shows the G1 electrode in an enlarged scale.

Another configuration for realizing an electron gun with an astigma, according to a tenth embodiment (Embodiment 10) will next be described with reference to FIG. 21A and FIG. 21B. FIG. 21A shows the configuration of the triode section of an electron gun, while FIG. 21B shows the G1 electrode in an enlarged scale. Reference numeral 51 denotes a cathode for emitting the electron beam, 52 denotes a heater, 53 denotes a G1 electrode, and 54 denotes a G2 electrode, 53*a* denotes an aperture provided in the G1 electrode 53*a*, and 54*a* denotes an aperture provided in the G2 electrode 54. In the present embodiment, the aperture 53*a* in the G1 electrode is elongated vertically, and the aperture 54*a* in the G2 electrode is circular.

The operation will next be described. The beam extracted from the cathode 51 is converged by the lens formed of the G1 and G2 electrodes 53 and 54 and travels toward the main lens, not shown.

When the electron beam is extracted, the G1 electrode 53 is normally connected to the ground, while a certain voltage is applied to the cathode 51, and another certain voltage is applied to the G2 electrode 54. By the potential difference between the G1 and G2 electrodes 53 and 54, an electrostatic lens is formed. If the G1 and G2 electrodes have circular apertures, the lens effect is equal in horizontal and vertical directions.

If the aperture 53*a* in the G1 electrode 53, forming the intermediate electrode, is vertically elongated, as illustrated, the converging power differ between the horizontal and vertical directions, (the converging power in the horizontal direction being larger than the converging power in the vertical direction), and as a result, an electron gun having an astigma can be obtained.

The electron gun with an astigma can be formed by the use of the configurations other than those described in connection with Embodiments 9 and 10. For instance, it can be formed by the use of the main lens having a race-track shape cross section, as explained in connection with Embodiment 2.

Embodiment 11

Figure 22A:
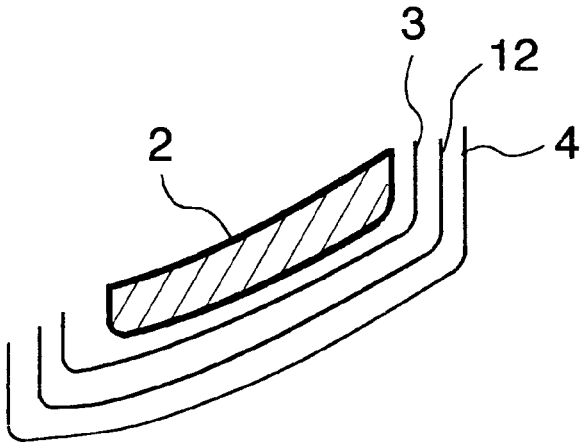
FIG. 22A shows the configuration of the coil in another embodiment (Embodiment 11) of the invention.
Figure 22B:
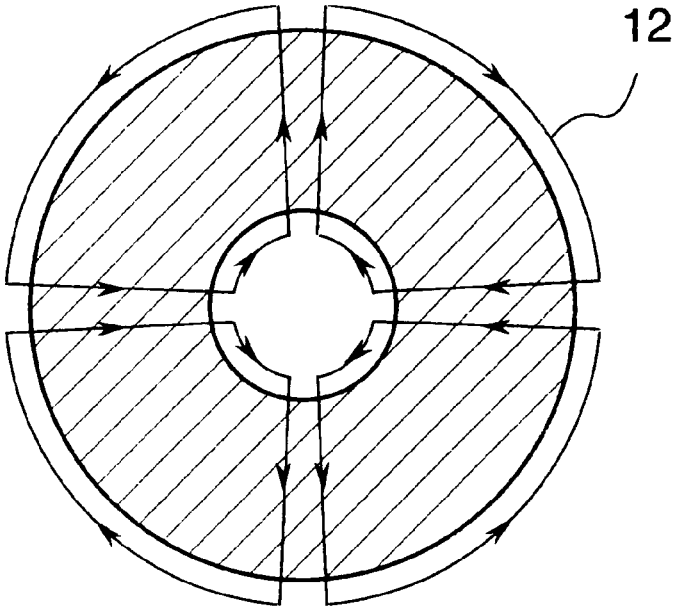
FIG. 22B shows the cross section of the quadrupole electromagnetic coil.

FIG. 22A to FIG. 22B, FIG. 23A to FIG. 23D show another embodiment (Embodiment 11) of the invention. FIG. 22A shows the configuration of the coil of the deflection yoke. Reference numeral 2 denotes a core of the deflection yoke, 3 denotes a vertical deflection coil, 4 denotes a horizontal deflection coil, and 12 denotes a quadrupole electromagnet coil. In this embodiment, only one quadrupole electromagnet is used. FIG. 22B shows the cross section of the quadrupole electromagnet coil.

Figure 23A:
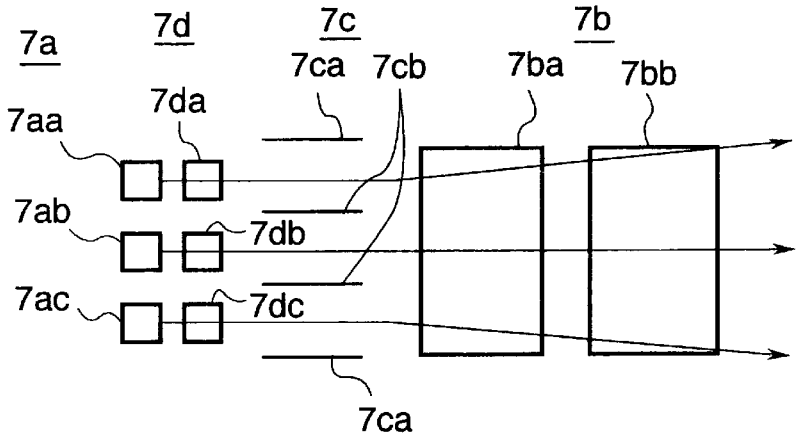
FIG. 23A shows the electrode configuration of the electron gun.

FIG. 23A shows the electrode configuration of the electron gun. Reference numeral 7*a* denotes a triode section, 7*b* denotes a main lens, 7*c* denotes a deflection electrode, 7*d* denotes a quadrupole electric field lens. The main lens 7*b* has the race-track configuration similar to that of Embodiment 2.

Figure 23B:
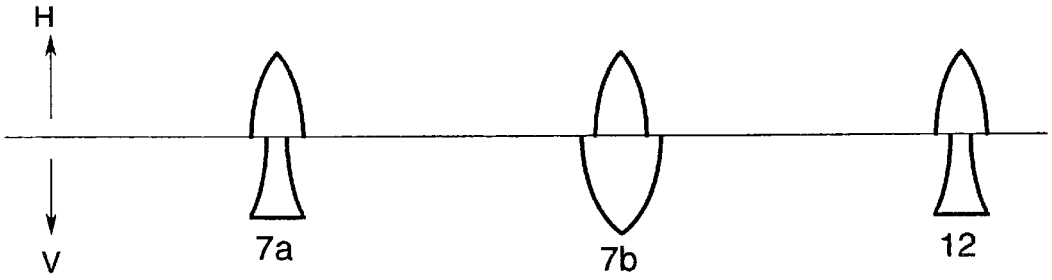
FIG. 23B is a schematic illustration of the functions of the electrodes in the electron gun and the deflection yoke.

FIG. 23B is a schematic illustration of the functions of the electrodes in the electron gun and the deflection yoke. The quadrupole lens 7*d* has a horizontally converging function and a vertically diverging function. The main lens 7*b* has a horizontally weak converging function, and a vertically strong converging function. The quadrupole electromagnet 12 in the deflection yoke has a horizontally converging function and a vertically diverging function. Like Embodiment 2, the main lens 7*b* can be considered as a combination of a converging lens having a converging function uniform in all directions, and a quadrupole electric field lens having a horizontally diverging function and a vertically converging function. The present embodiment can therefore be considered as a combination of a converging lens having a converging function uniform in all directions, and a triplet arrangement comprising three quadrupole lenses. Effectively, the function of the deflection system inherent in the triplet arrangement is as explained in connection with Embodiment 2.

The quadrupole electric field lens 7*d* forms the triplet arrangement described above, and the quadrupole electric field function of 7*da* and 7*dc* on both sides are made to be different from that of 7*db* at the center to correct the astigma of the side beams generated by the deflection electrode 7*c*.

Figure 23C:
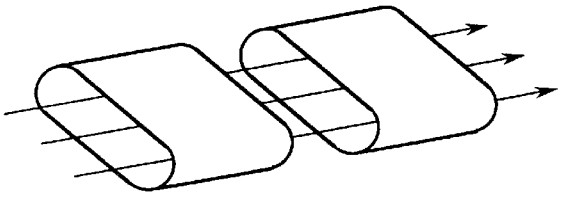
FIG. 23C shows a main lens of a race-track configuration.
Figure 23D:
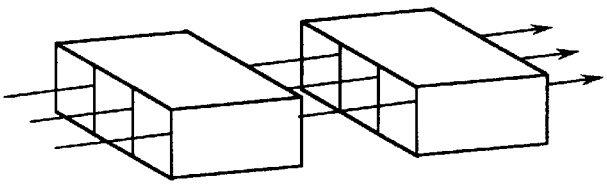
FIG. 23D shows a vertically elongated main lens.

In the present embodiment, the use of an main lens of a race-track configuration shown in FIG. 23C is assumed. However, if a vertically elongated main lens is used for each beam as shown in FIG. 23D, the quadrupole lens function inherent in the main lens will have a polarity opposite to that of the case shown in FIG. 23C. If the main lens shown in FIG. 23D is used, the polarities of the quadrupole electric field 7*d* and the quadrupole electromagnet 12 are made opposite (to that of the above description). Then, a triplet arrangement whose overall polarity is opposite (to that of the above description) will be obtained.

In the present embodiment as well, the quadrupole electromagnet 12 is driven by a d.c. current. In place of the quadrupole electromagnet, a sub yoke of a quadrupole electromagnet, described in connection with Embodiment 4, can be used.

Embodiment 12

Figure 24A:
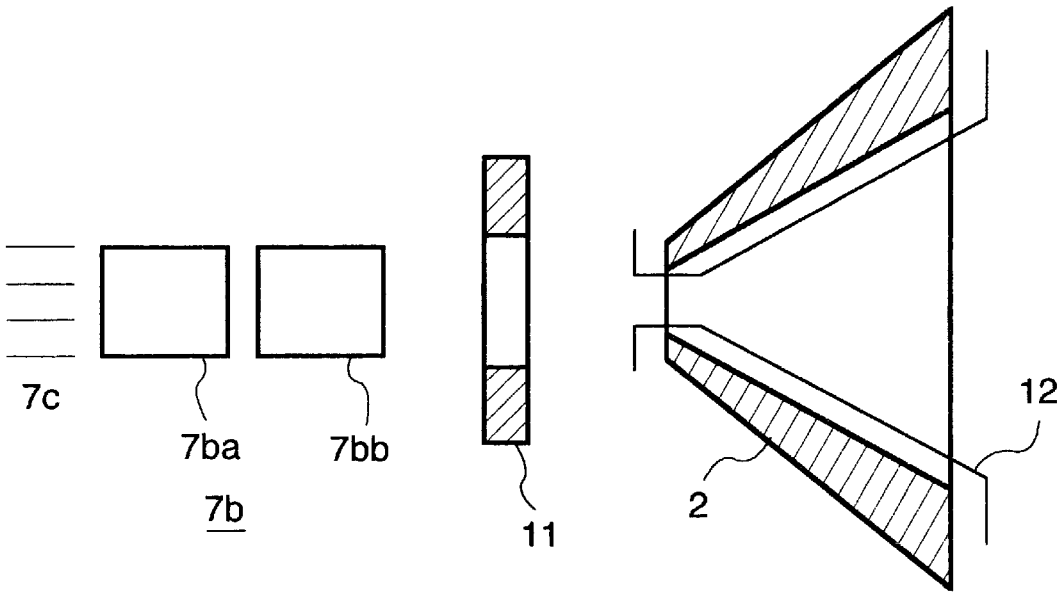
FIG. 24A and FIG. 24B show another embodiment (Embodiment 12) of the invention.
Figure 24B:
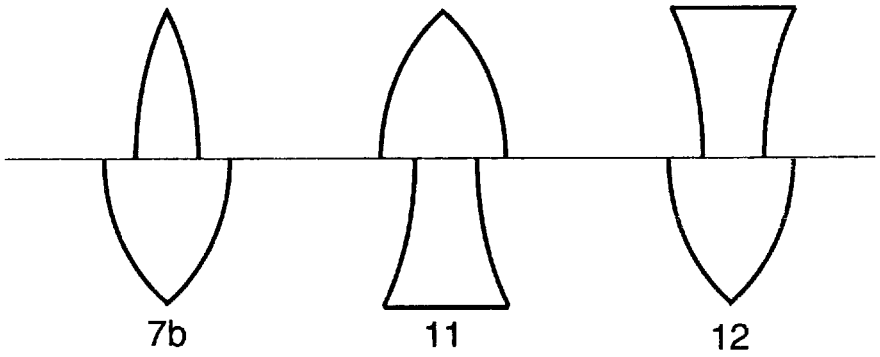
Figure 25:
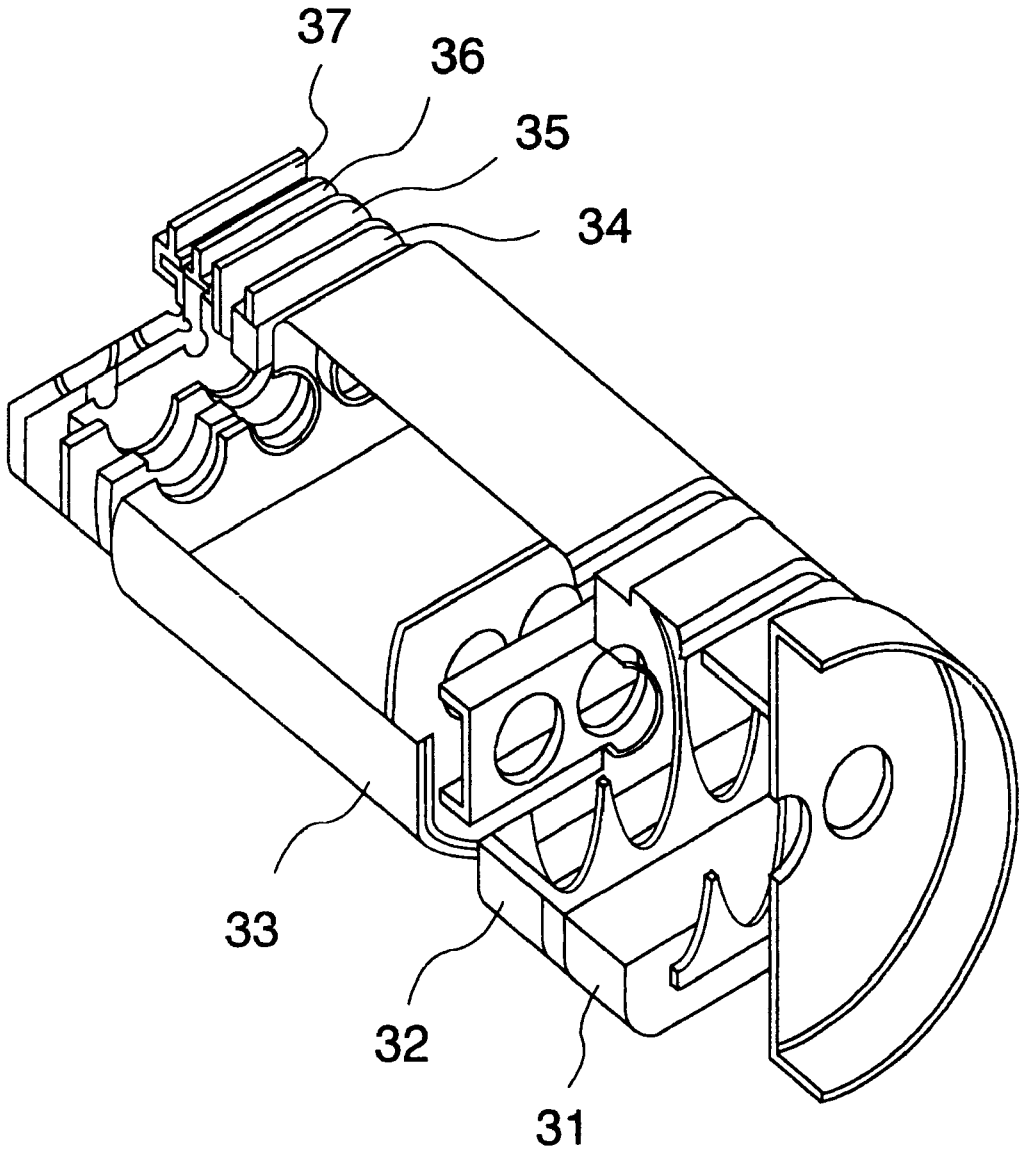
FIG.25 PRIOR ART
FIG. 25 shows a perspective view, partially in cross section, of electrodes in a conventional electron gun.
Figure 26B:
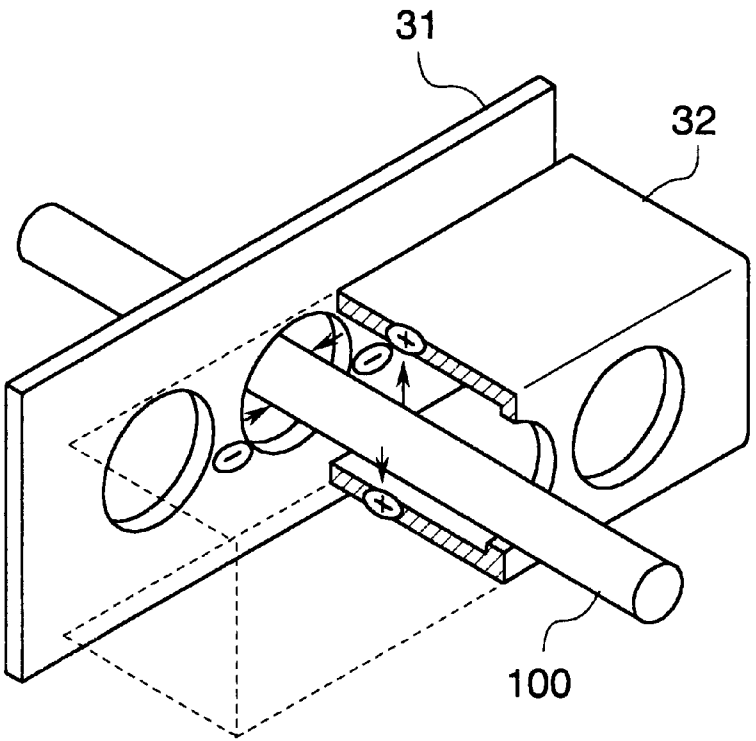
FIG.26B PRIOR ART
FIG. 26A and FIG. 26B show the details of two different examples DBF electrode.
Figure 26A:
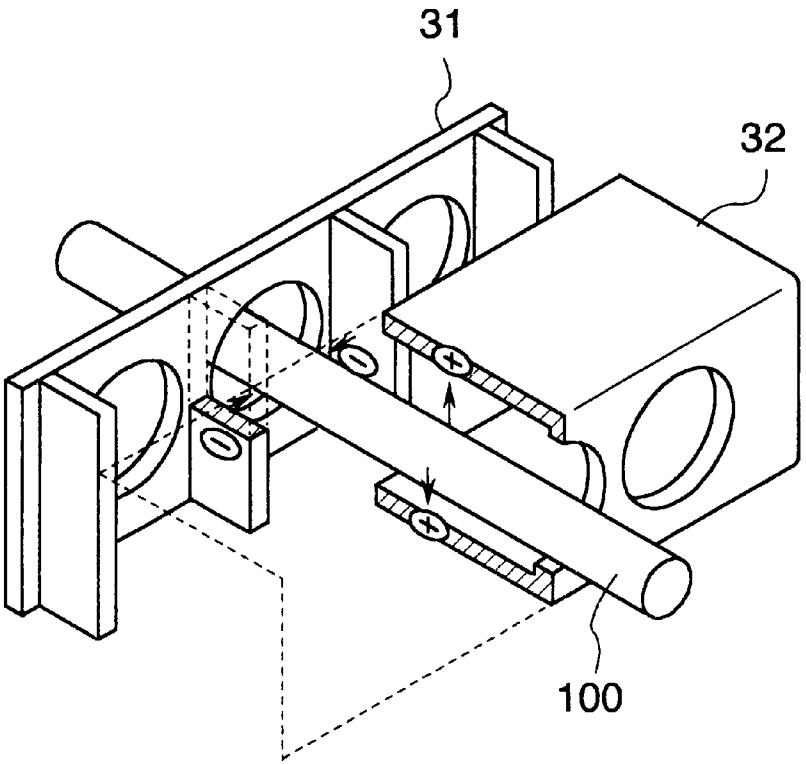
FIG.26A PRIOR ART
Figure 27A:
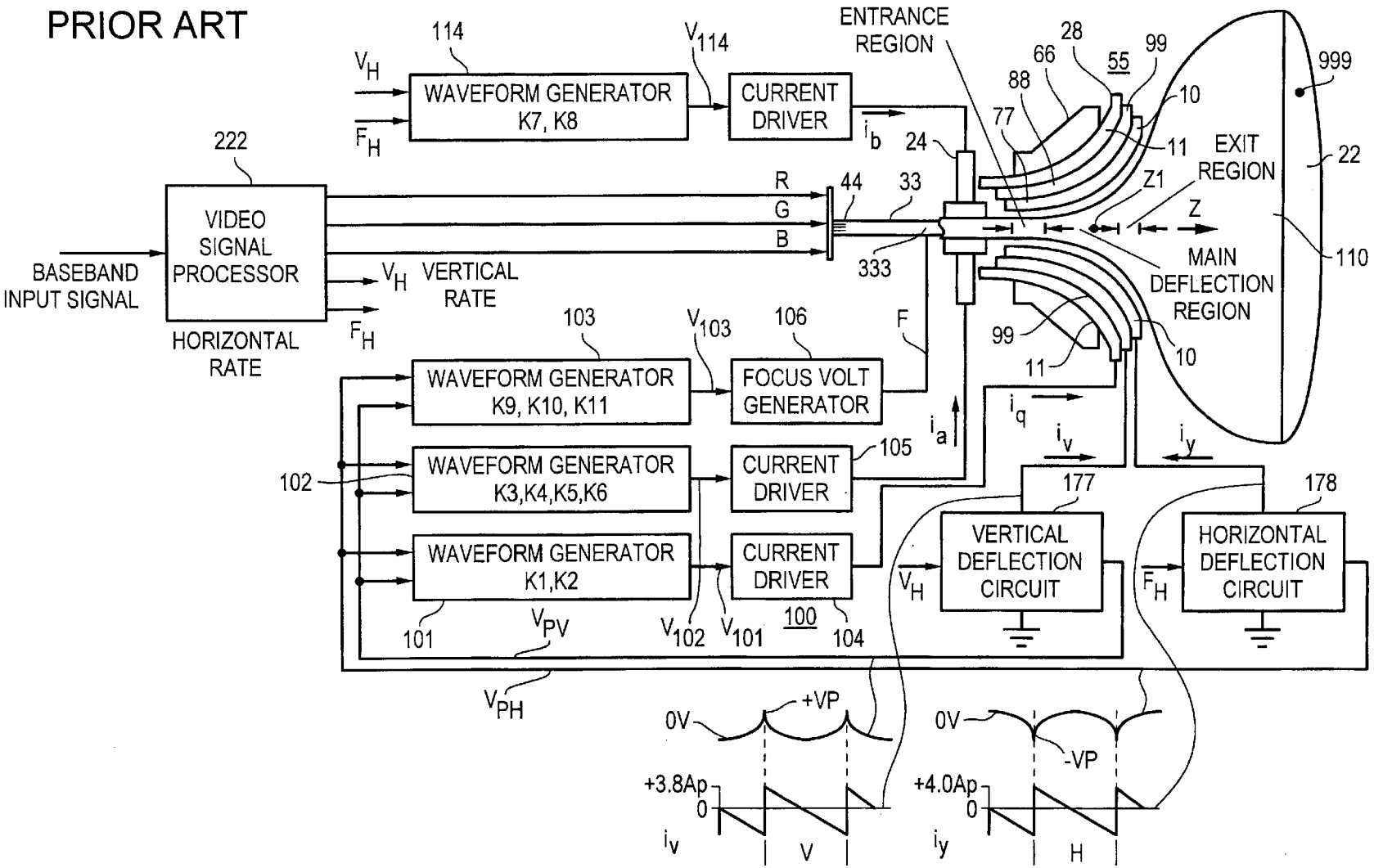
FIG.27A PRIOR ART
FIG. 27A shows the general configuration of a deflection system in a color CRT.
Figure 27B:
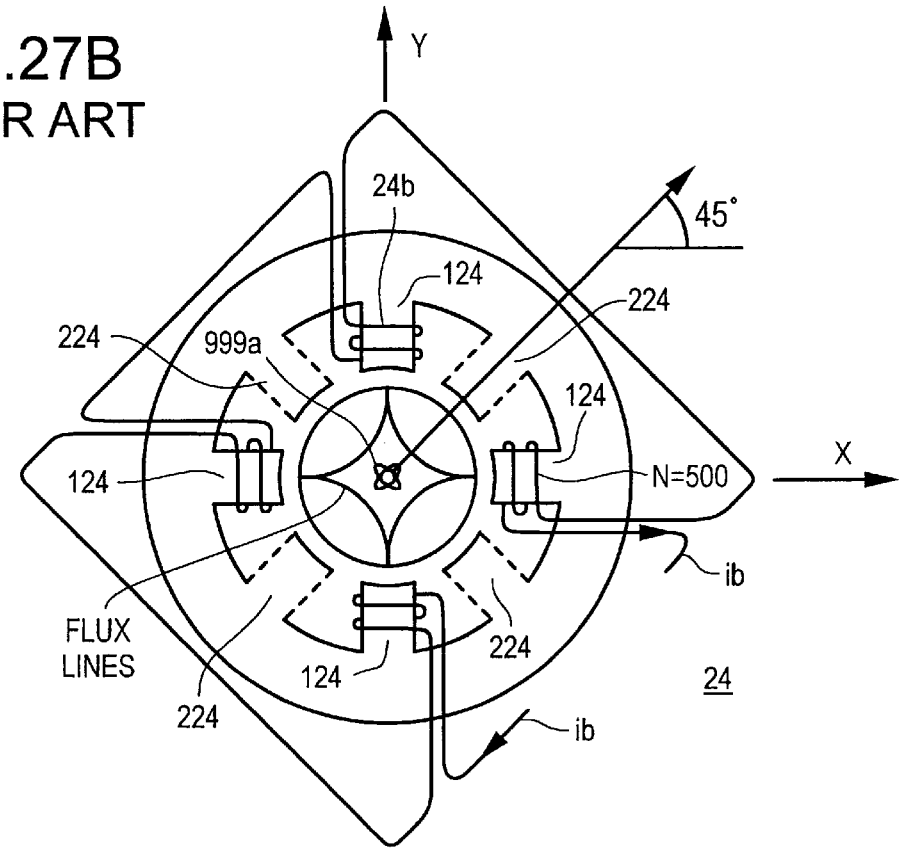
FIG.27B PRIOR ART
FIG. 27B shows an astigma correction element formed of a quadrupole electromagnet and FIG. 27C shows a 45 degree-shifted quadrupole electromagnet.
Figure 27C:
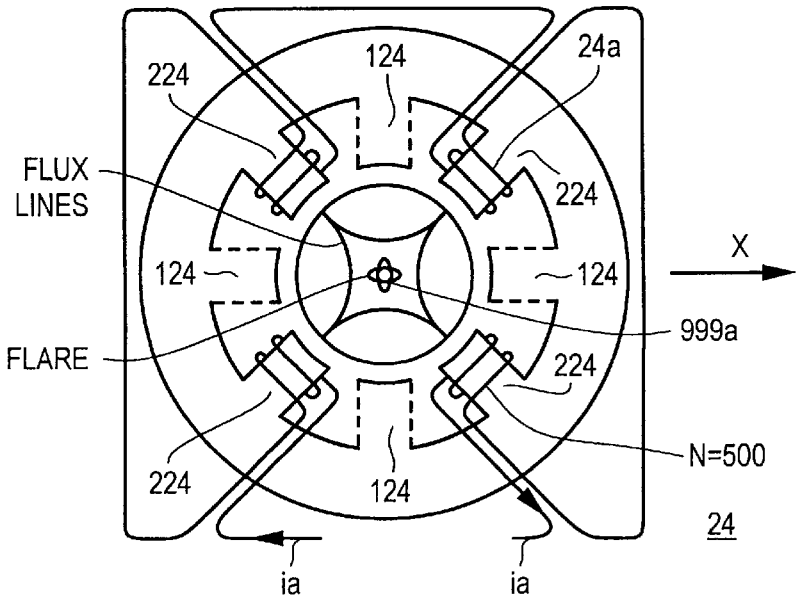
FIG.27C PRIOR ART
Figure 28A:
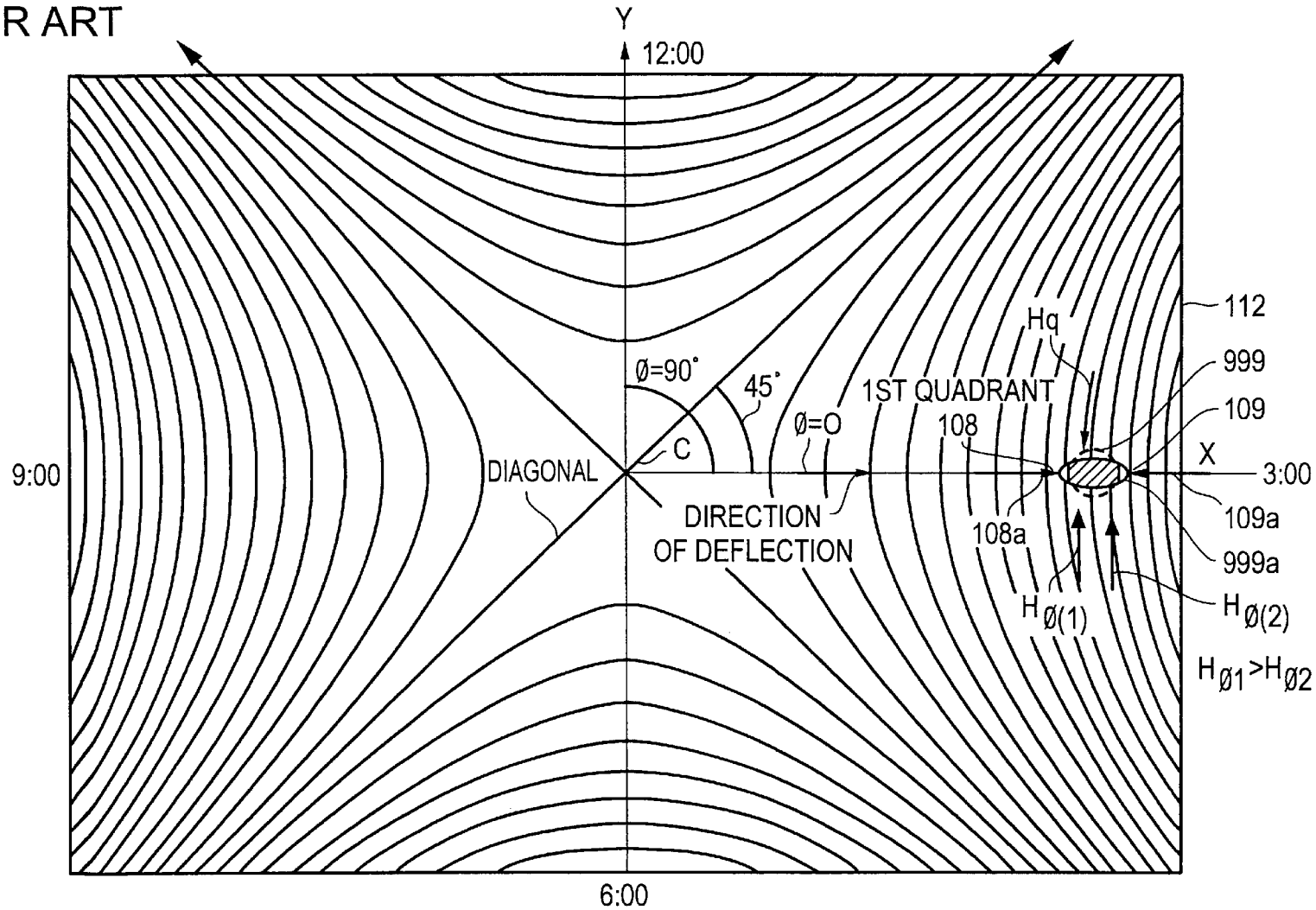
FIG.28A PRIOR ART
FIG. 28A shows a magnetic field generated by the quadrupole electromagnet.
Figure 28B:
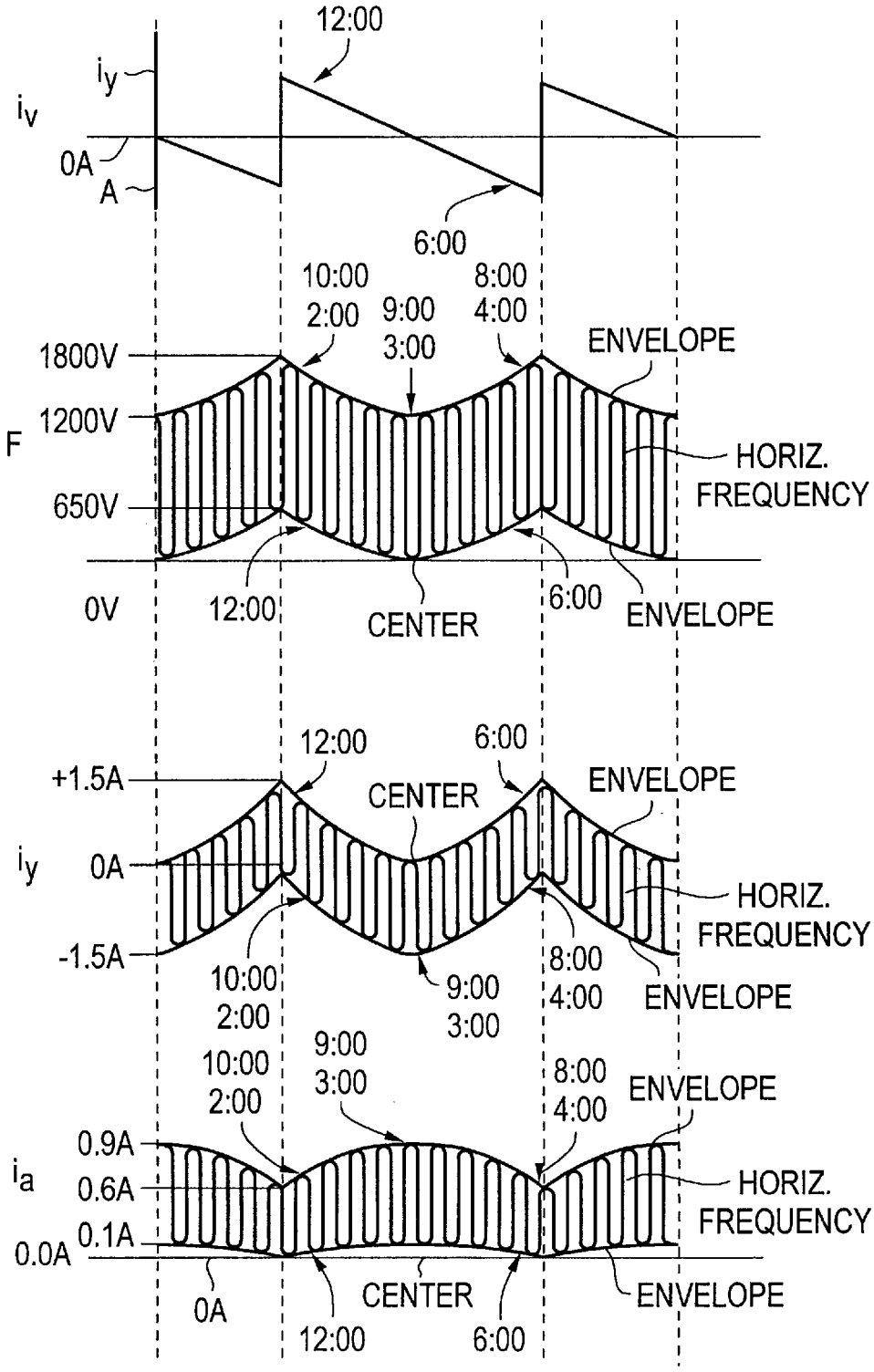
FIG.28B PRIOR ART
FIG. 28B shows a waveform of a drive current for the quadrupole electromagnet.

FIG. 24A and FIG. 24B show another embodiment (Embodiment 12) of the invention. FIG. 24A shows the overall configuration. The present embodiment employs the race-track shape main lens 7*b* in the electron gun, deflection electrode 7*c*, a quadrupole electromagnet 11 in the sub yoke in the deflection yoke neck part, and a quadrupole electromagnet 12 in the deflection yoke.

FIG. 24B is a schematic illustration of the converging and diverging functions of the three lenses. The main lens has a horizontally weak converging function and a vertically strong converging function, and can be considered as a combination of a converging lens having a uniform converging function in all directions, and a quadrupole electric field lens having a horizontally diverging function and a vertically converging function. The three lens arrangement can be considered as a combination of a converging lens having a converging function uniform in all directions and a triplet arrangement comprising three quadrupole lenses. Effectively, the function of the deflection system containing the triplet arrangement is as described in connection with Embodiment 2.

In the present embodiment as well, astigma is generated in the side beam due to the deflection yoke 7*c*, like Embodiment 2, but the method of correction of the astigma described in connection with Embodiment 3 can be applied similarly.

In the present embodiment as well, the quadrupole electromagnets 11 and 12 are driven by a d.c.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A color CRT having an in-line electron gun and a self-converging deflection yoke, comprising:

a first quadrupole electro-magnetic coil provided on the deflection yoke and forming a plurality of first loops which are wider at a screen side of said deflection yoke than at a neck side of said deflection yoke; and a second quadrupole electro-magnetic coil provided on the deflection yoke and forming a plurality of second loops which are wider at the neck side of said deflection yoke than at the screen side of said deflection yoke.

2. A color CRT according to claim 1, wherein a main lens of the in-line electron gun has a cross-section of a race-track shape.

3. A color CRT according to claim 2, wherein a deflection electrode, for deflecting side beams, generated from the electron gun, is provided adjacent to the main lens of the in-line electron gun.

4. A color CRT according to claim 3, further including a quadrupole electric-field lens for correcting an astigma of the side beams, provided adjacent to the deflection electrode.

5. A color CRT according to claim 3, having an 8-pole electro-magnet driven by a d.c. current, for correcting the astigma of the side beams, provided adjacent to the main lens of the gun.

6. A color CRT according to claim 1, having a sub yoke of at least one of a quadrupole permanent magnet and a quadrupole electromagnet driven by a d.c. current, provided at the neck part of the deflection yoke.

7. A color CRT according to claim 1, wherein a horizontal deflection magnetic field of the deflection yoke is altered along an axis of the CRT so that it is barrel-shaped, then pincushion-shaped, and then barrel-shaped toward the screen, and the in-line electron gun is so configured as to have converging power different between vertical and horizontal directions.

8. A color CRT according to claim 7, further including a winding guide for winding the horizontal deflection coil on the deflection yoke.

9. A color CRT according to claim 7, wherein a magnetic core projects outwardly from the deflection yoke.

10. A color CRT according to claim 7, wherein an electrostatic lens forming the main lens of the in-line electron gun has a cylindrical electrode having an inner bore of a race-track shape, and a metal plate having apertures corresponding to the respective electron beams disposed inside the cylindrical electrode, and projecting flat electrodes are provided above and below the apertures on the cylindrical electrode.

11. A color CRT according to claim 7, wherein an electrostatic lens forming the main lens of the in-line electron gun has a cylindrical electrode having an inner bore of a race-track shape, and a metal plate having apertures corresponding to the respective electron beams disposed inside the cylindrical electrode, and apertures the communicating by a slit having a width smaller than the diameter of the apertures.

12. A color CRT according to claim 7, wherein the apertures of the G1 or G2 electrodes forming the triode section of the electron gun are elongated vertically or horizontally.

13. A color CRT according to claim 1, wherein said electron gun comprises a main lens provided in the electron gun and having a cross-section in the form of a race-track, a deflection electrode provided adjacent to the main lens for deflecting side beams generated by the electron gun, and a quadrupole electric field lens provided adjacent to the deflection yoke, wherein said first and second quadrupole electro-magnet coils are driven by a d.c. current so as to produce first and second quadrupole lenses.

14. A color CRT according to claim 1, wherein said electron gun comprises a main lens provided in the electron gun and having a cross-section in the form of a race-track, and a deflection electrode provided adjacent to the main lens for deflecting side beams generated by the electron gun, said first and second quadrupole electro-magnet coils are driven by a d.c. current so as to produce first and second quadrupole lenses, and said CRT further comprises a quadrupole electro-magnet having a sub yoke provided at the neck part of the deflection yoke and driven by a d.c. current so as to produce a third quadrupole lens.

15. A color CRT, according to claim 1, wherein said electron gun generates a plurality of electron beams; and said CRT further comprises converging means for converging said plurality of electron beams in both a horizontal and a vertical direction, said converging means being configured in a doublet lens arrangement of quadrupole lenses including said first and second quadrupole electro-magnetic coils which produces first and second quadrupole lenses.

16. The color CRT of claim 15, said doublet lens arrangement imparting first and second magnetic fields on the plurality of electron beams, said first magnetic field horizontally converging and vertically diverging the plurality of electron beams, said second magnetic field horizontally diverging and vertically converging the plurality of electron beams.

17. The color CRT of claim 15 further including at least one of a main lens and a sub yoke for cooperating with said doublet arrangement to form a triplet lens arrangement of quadrupole lenses, said triplet arrangement imparting first, second, and third magnetic fields on the plurality of electron beams, at least one of said first, second, and third magnetic fields horizontally converging and vertically diverging the plurality of electron beams, and at least one of said first, second, and third magnetic fields horizontally diverging and vertically converging the plurality of electron beams.

18. The color CRT of claim 15, further comprising astigma correcting means for correcting astigma of at least one of the plurality of electron beams.

19. The color CRT of claim 16, further comprising astigma correcting means for correcting astigma of at least one of the plurality of electron beams.

20. The color CRT of claim 17, further comprising astigma correcting means for correcting astigma of at least one of the plurality of electron beams.

21. A color CRT according to claim 1, wherein a polarity of a quadrupole magnetic field at the neck side generated by said first and second quadrupole electro-magnetic coils and a polarity of a quadrupole magnetic field at the screen side generated by said first and second quadrupole electro-magnetic coils are opposite to each other; and directions of currents in the first and second quadrupole electro-magnetic coils are opposite to each other so that a polarity of the magnetic field generated by the first quadrupole electro-magnetic coil and a polarity of the magnetic field generated by the second quadrupole electro-magnetic coil are opposite to each other.

* * * * *